US012402696B2

(12) United States Patent
Schneider et al.

(10) Patent No.: US 12,402,696 B2
(45) Date of Patent: Sep. 2, 2025

(54) LACING ENGINE FOR AUTOMATED FOOTWEAR PLATFORM

(71) Applicant: NIKE, Inc., Beaverton, OR (US)

(72) Inventors: Summer L. Schneider, Beaverton, OR (US); Daniel A. Johnson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 215 days.

(21) Appl. No.: 18/113,798

(22) Filed: Feb. 24, 2023

(65) Prior Publication Data

US 2023/0189935 A1 Jun. 22, 2023

Related U.S. Application Data

(60) Continuation of application No. 16/740,749, filed on Jan. 13, 2020, now Pat. No. 11,607,013, which is a (Continued)

(51) Int. Cl.
*A43C 11/16* (2006.01)
*A43B 3/34* (2022.01)

(Continued)

(52) U.S. Cl.
CPC ..... *A43C 11/165* (2013.01); *A43B 3/34* (2022.01); *A43B 3/36* (2022.01); *A43B 3/38* (2022.01);

(Continued)

(58) Field of Classification Search
None
See application file for complete search history.

(56) References Cited

U.S. PATENT DOCUMENTS 64,155 A 4/1867 Sickels et al.
3,808,644 A 5/1974 Schoch (Continued)

FOREIGN PATENT DOCUMENTS

CN 2540805 Y 3/2003
CN 2613167 Y 4/2004

(Continued)

OTHER PUBLICATIONS

"U.S. Appl. No. 15/452,636, Non Final Office Action mailed Sep. 15, 2017", 17 pgs.

(Continued)

*Primary Examiner* — Jameson D Collier
(74) *Attorney, Agent, or Firm* — Schwegman Lundberg & Woessner, P.A.

(57) ABSTRACT

Systems and apparatus related to footwear including a modular lacing engine are discussed. In an example, a modular footwear apparatus including an upper portion, a lower portion, and a lacing engine is described. The upper portion can include a lace to adjust fit of the upper portion against a foot, the lace adjustable between a first position and a second position based at least in part on manipulation of an effective length of the lace. The lower portion can include a mid-sole and an out-sole, and the lower portion can be coupled to the upper portion at the mid-sole. The lacing engine can include a top-loading lace spool to engage a loop of the lace to enable manipulation of the effective length of the lace through rotation of the lace spool, the lacing engine received within a cavity in the lower portion.

20 Claims, 30 Drawing Sheets

Related U.S. Application Data division of application No. 15/945,797, filed on Apr. 5, 2018, now Pat. No. 10,531,708, which is a continuation of application No. 15/452,636, filed on Mar. 7, 2017, now Pat. No. 9,961,963.

(60) Provisional application No. 62/308,638, filed on Mar. 15, 2016.

(51) Int. Cl.

| | |
|---|---|
| ***A43B 3/36*** | (2022.01) |
| ***A43B 3/38*** | (2022.01) |
| ***A43B 13/14*** | (2006.01) |
| ***A43C 1/00*** | (2006.01) |
| ***A43C 7/00*** | (2006.01) |
| ***B65H 59/00*** | (2006.01) |
| *B65H 69/00* | (2006.01) |

(52) U.S. Cl.

CPC ..... *A43B 13/14* (2013.01); *A43C 1/00* (2013.01); *A43C 7/00* (2013.01); *B65H 59/00* (2013.01); *B65H 69/00* (2013.01)

(56) References Cited

U.S. PATENT DOCUMENTS

| | | | |
|---|---|---|---|
| 4,724,626 | A | 2/1988 | Baggio |
| 4,961,544 | A | 10/1990 | Bidoia |
| 5,934,599 | A | 8/1999 | Hammerslag |
| 5,983,530 | A | 11/1999 | Chou |
| 6,032,387 | A | 3/2000 | Johnson |
| 6,691,433 | B2 | 2/2004 | Liu |
| 6,896,128 | B1 | 5/2005 | Johnson |
| 7,614,166 | B2 | 11/2009 | Vick et al. |
| 7,721,468 | B1 | 5/2010 | Johnson et al. |
| 7,752,774 | B2 | 7/2010 | Ussher |
| 8,904,672 | B1 | 12/2014 | Johnson |
| 9,693,605 | B2 | 7/2017 | Beers |
| 9,861,165 | B2 | 1/2018 | Schneider et al. |
| 9,961,963 | B2 | 5/2018 | Schneider et al. |
| 10,111,496 | B2 | 10/2018 | Schneider et al. |
| 10,390,589 | B2 | 8/2019 | Schneider et al. |
| 10,517,355 | B2 * | 12/2019 | Schneider ..... A43C 1/00 |
| 10,531,708 | B2 | 1/2020 | Schneider et al. |
| 11,272,762 | B2 * | 3/2022 | Schneider ..... B65H 59/00 |
| 11,607,013 | B2 | 3/2023 | Schneider et al. |
| 2002/0095750 | A1 | 7/2002 | Hammerslag |
| 2003/0150135 | A1 | 8/2003 | Liu |
| 2003/0204938 | A1 | 11/2003 | Hammerslag |
| 2005/0198867 | A1 | 9/2005 | Labbe |
| 2008/0301919 | A1 | 12/2008 | Ussher |
| 2008/0307673 | A1 | 12/2008 | Johnson |
| 2009/0272007 | A1 | 11/2009 | Beers et al. |
| 2013/0086816 | A1 | 4/2013 | Johnson et al. |
| 2014/0068838 | A1 | 3/2014 | Beers et al. |
| 2014/0082963 | A1 | 3/2014 | Beers |
| 2014/0174205 | A1 | 6/2014 | Clarke et al. |
| 2014/0208550 | A1 | 7/2014 | Neiley |
| 2015/0047230 | A1 | 2/2015 | Beers |
| 2015/0289594 | A1 | 10/2015 | Rushbrook et al. |
| 2017/0265572 | A1 * | 9/2017 | Beers ..... B23B 51/10 |
| 2017/0265577 | A1 | 9/2017 | Schneider |
| 2017/0265579 | A1 | 9/2017 | Schneider et al. |
| 2017/0265580 | A1 | 9/2017 | Schneider et al. |
| 2017/0265593 | A1 | 9/2017 | Schneider et al. |
| 2018/0263340 | A1 | 9/2018 | Schneider et al. |
| 2018/0289110 | A1 | 10/2018 | Bock et al. |
| 2018/0368526 | A1 | 12/2018 | Bock et al. |
| 2020/0146400 | A1 | 5/2020 | Schneider et al. |

FOREIGN PATENT DOCUMENTS

| | | | |
|---|---|---|---|
| CN | 101193568 | A | 6/2008 |
| CN | 102014682 | A | 4/2011 |
| CN | 102014682 | B | 1/2013 |
| CN | 203505737 | U | 4/2014 |
| CN | 104023579 | A | 9/2014 |
| CN | 104244757 | A | 12/2014 |
| CN | 104582519 | A | 4/2015 |
| CN | 104585975 | A | 5/2015 |
| CN | 104822284 | A | 8/2015 |
| CN | 104582519 | B | 4/2016 |
| CN | 109068803 | A | 12/2018 |
| CN | 109068803 | B | 11/2019 |
| CN | 110731571 | A | 1/2020 |
| CN | 110731571 | B | 10/2022 |
| DE | 3900777 | A1 | 7/1990 |
| DE | 102005036013 | A1 | 2/2007 |
| EP | 1421867 | A1 | 5/2004 |
| EP | 3429398 | B1 | 9/2021 |
| EP | 3964095 | | 12/2023 |
| JP | 48005543 | A | 9/1974 |
| JP | S59022503 | A | 2/1984 |
| JP | 2009500141 | A | 1/2009 |
| JP | 2011509710 | A | 3/2011 |
| JP | 2011519611 | A | 7/2011 |
| JP | 2011524207 | A | 9/2011 |
| JP | 2015000297 | A | 1/2015 |
| JP | 2016530058 | A | 9/2016 |
| JP | 2019509124 | A | 4/2019 |
| JP | 6634164 | B2 | 12/2019 |
| JP | 2020054831 | A | 4/2020 |
| JP | 6935480 | B2 | 8/2021 |
| JP | 2021191431 | A | 12/2021 |
| JP | 7210668 | B2 | 1/2023 |
| JP | 202352319 | A | 4/2023 |
| JP | 7445025 | | 2/2024 |
| KR | 101569461 | B1 | 11/2015 |
| KR | 101992842 | B1 | 6/2019 |
| KR | 102207591 | B1 | 1/2021 |
| KR | 20210010645 | A | 1/2021 |
| KR | 102332378 | B1 | 12/2021 |
| KR | 20210148375 | A | 12/2021 |
| KR | 102447657 | B1 | 9/2022 |
| TW | 521593 | U | 2/2003 |
| TW | 201739371 | A | 11/2017 |
| TW | 201902382 | A | 1/2019 |
| TW | I721132 | B | 3/2021 |
| TW | I736797 | | 8/2021 |
| TW | 202139878 | A | 11/2021 |
| TW | I766763 | B | 6/2022 |
| TW | 202231212 | A | 8/2022 |
| TW | I831198 | | 2/2024 |
| TW | 202416854 | | 5/2024 |
| WO | WO-2009071652 | A1 | 6/2009 |
| WO | WO-2014188350 | A1 | 11/2014 |
| WO | WO-2015160768 | A1 | 10/2015 |
| WO | WO-2017160558 | A2 | 9/2017 |

OTHER PUBLICATIONS

"U.S. Appl. No. 15/452,636, Notice of Allowance mailed Feb. 12, 2018", 10 pgs.
"U.S. Appl. No. 15/452,636, Response filed Sep. 6, 2017 to Restriction Requirement mailed Jul. 6, 2017", 7 pgs.
"U.S. Appl. No. 15/452,636, Response filed Dec. 15, 2017 to Non Final Office Action mailed Sep. 15, 2017", 17 pgs.
"U.S. Appl. No. 15/452,636, Restriction Requirement mailed Jul. 6, 2017", 6 pgs.
"U.S. Appl. No. 15/610,151, Non Final Office Action mailed Jul. 12, 2017", 15 pgs.
"U.S. Appl. No. 15/610,151, Notice of Allowance mailed Oct. 24, 2017", 8 pgs.
"U.S. Appl. No. 15/610,151, Preliminary Amendment filed Jun. 28, 2017", 6 pgs.
"U.S. Appl. No. 15/610,151, Response filed Sep. 27, 2017 to Non Final Office Action mailed Jul. 12, 2017", 14 pgs.
"U.S. Appl. No. 15/945,797, Non Final Office Action mailed May 1, 2019", 13 pgs.
"U.S. Appl. No. 15/945,797, Notice of Allowance mailed Aug. 30, 2019", 7 pgs.

(56) References Cited

OTHER PUBLICATIONS

"U.S. Appl. No. 15/945,797, Preliminary Amendment filed Jun. 6, 2018", 6 pgs.
"U.S. Appl. No. 15/945,797, Response filed Aug. 2, 2019 to Non-Final Office Action mailed May 1, 2019", 14 pgs.
"U.S. Appl. No. 15/945,797, Restriction Requirement mailed Feb. 15, 2019", 6 pgs.
"U.S. Appl. No. 16/740,749, Non Final Office Action mailed Aug. 8, 2022", 9 pgs.
"U.S. Appl. No. 16/740,749, Notice of Allowance mailed Nov. 25, 2022", 7 pgs.
"U.S. Appl. No. 16/740,749, Preliminary Amendment filed Jan. 30, 2020", 5 pgs.
"U.S. Appl. No. 16/740,749, Response filed Nov. 8, 2022 to Non Final Office Action mailed Aug. 8, 2022", 6 pgs.
"U.S. Appl. No. 15/945,797, Response filed Apr. 12, 2019 to Restriction Requirement mailed Feb. 15, 2019", 7 pgs.
"Chinese Application Serial No. 201780025585.4, Office Action mailed Feb. 18, 2019", w/ English translation, 9 pgs.
"Chinese Application Serial No. 201780025585.4, Response filed Jun. 27, 2019 to Office Action mailed Feb. 18, 2019", w/ English claims, 42 pgs.
"Chinese Application Serial No. 201911001988.2, Decision of Rejection mailed Feb. 23, 2022", With English machine translation, 16 pgs.
"Chinese Application Serial No. 201911001988.2, Office Action mailed Jan. 7, 2021", w/ English translation, 18 pgs.
"Chinese Application Serial No. 201911001988.2, Office Action mailed Oct. 15, 2021", With English translation, 17 pgs.
"Chinese Application Serial No. 201911001988.2, Response filed Jun. 10, 2022 to Decision of Rejection mailed Feb. 23, 2022", w/ English claims, 17 pgs.
"Chinese Application Serial No. 201911001988.2, Response filed Jul. 22, 2021 to Office Action mailed Jan. 7, 2021", With English claims, 13 pages.
"Chinese Application Serial No. 201911001988.2, Response filed Dec. 15, 2021 to Office Action mailed Oct. 15, 2021", w/ English claims, 18 pgs.
"European Application Serial No. 17767175.7, Extended European Search Report mailed Oct. 23, 2019", 8 pgs.
"European Application Serial No. 17767175.7, Response filed Apr. 28, 2020 Extended European Search Report mailed Oct. 23, 2019", 13 pgs.
"European Application Serial No. 17767175.7, Response filed Apr. 29, 2019 to Communication Pursuant to Rules 161 and 162 mailed Nov. 5, 2018", 12 pgs.
"European Application Serial No. 21193659.6, Extended European Search Report mailed Feb. 1, 2022", 9 pgs.
"European Application Serial No. 21193659.6, Response filed Sep. 6, 2022 to Extended European Search Report mailed Feb. 1, 2022", 13 pgs.
"European Application Serial No. 21193659.6, Response filed Oct. 27, 2021 to Invitation to Remedy Deficiencies (R. 58 EPC) mailed Sep. 6, 2021", 10 pgs.
"International Application Serial No. PCT/US2017/021393, International Preliminary Report on Patentability mailed Sep. 27, 2018", 7 pgs.
"International Application Serial No. PCT/US2017/021393, International Search Report mailed Jun. 16, 2017", 4 pgs.
"International Application Serial No. PCT/US2017/021393, Written Opinion mailed Jun. 16, 2017", 6 pgs.
"Japanese Application Serial No. 2018-548671, Notification of Reasons for Rejection mailed Jul. 2, 2019", w/ English Translation, 4 pgs.
"Japanese Application Serial No. 2018-548671, Office Action mailed Feb. 26, 2019", W/ English Translation, 7 pgs.
"Japanese Application Serial No. 2018-548671, Response filed Jun. 19, 2019 to Office Action mailed Feb. 26, 2019", w/ English claims, 10 pgs.
"Japanese Application Serial No. 2018-548671, Response filed Aug. 14, 2019 to Notification of Reasons for Rejection mailed Jul. 2, 2019", w/ English claims, 10 pgs.
"Japanese Application Serial No. 2018-548671, Voluntary Amendment / PPH Request filed Oct. 26, 2018", w/ English claims, 49 pgs.
"Japanese Application Serial No. 2019-225900, Notification of Reasons for Refusal mailed Feb. 2, 2021", w/ English translation, 4 pgs.
"Japanese Application Serial No. 2019-225900, Response filed Jun. 30, 2021 to Notification of Reasons for Refusal mailed Feb. 2, 2021", w/ English claims, 10 pgs.
"Japanese Application Serial No. 2021-137278, Notification of Reasons for Refusal mailed Aug. 2, 2022", w/ English Translation, 7 pgs.
"Japanese Application Serial No. 2021-137278, Response filed Nov. 1, 2022 to Notification of Reasons for Refusal mailed Aug. 2, 2022", w/ English claims, 9 pgs.
"Japanese Application Serial No. 2023-002378, Voluntary Amendment filed Feb. 8, 2023", English claims, 10 pgs.
"Korean Application Serial No. 10-2018-7029698, Office Action mailed Dec. 16, 2018", w/ English summary, 5 pgs.
"Korean Application Serial No. 10-2018-7029698, Response filed Feb. 18, 2019 to Office Action mailed Dec. 16, 2018", w/ English claims, 69 pgs.
"Korean Application Serial No. 10-2019-7017652, Notice of Preliminary Rejection mailed Apr. 26, 2020", w/ English translation, 14 pgs.
"Korean Application Serial No. 10-2019-7017652, Response filed Jun. 10, 2020 to Notice of Preliminary Rejection mailed Apr. 26, 2020", w/ English claims, 58 pgs.
"Korean Application Serial No. 10-2021-7001739, Notice of Preliminary Rejection mailed Mar. 25, 2021", w/ English translation, 9 pgs.
"Korean Application Serial No. 10-2021-7001739, Response filed Jul. 16, 2021 to Notice of Preliminary Rejection mailed Mar. 25, 2021", With English claims, 22 pages.
"Korean Application Serial No. 10-2021-7038236, Notice of Preliminary Rejection mailed Dec. 22, 2021", W/English Translation, 8 pgs.
"Korean Application Serial No. 10-2021-7038236, Response Filed Feb. 3, 2022 to Notice of Preliminary Rejection mailed Dec. 22, 2021", w/English Claims, 29 pgs.
"Taiwanese Application Serial No. 106108511, Decision of Rejection mailed Jul. 20, 2018", With English translation, 5 pgs.
"Taiwanese Application Serial No. 106108511, Office Action mailed Feb. 12, 2020", With English translation, 5 pgs.
"Taiwanese Application Serial No. 106108511, Office Action mailed Dec. 5, 2017", With English translation, 16 pgs.
"Taiwanese Application Serial No. 106108511, Request for Reexamination filed Sep. 21, 2018 to Decision of Rejection mailed Jul. 20, 2018", With English claims, Claims not amended in Reexamination brief, current claims included in attachment, 236 pgs.
"Taiwanese Application Serial No. 106108511, Response filed Mar. 5, 2018 to Office Action mailed Dec. 5, 2017", With English claims, 110 pgs.
"Taiwanese Application Serial No. 106108511, Response filed Aug. 7, 2020 to Office Action mailed Feb. 12, 2020", With English translation of replacement pages. 185 pgs.
"Taiwanese Application Serial No. 107134260, Office Action mailed Feb. 17, 2020", With English translation, 4 pgs.
"Taiwanese Application Serial No. 107134260, Response filed Aug. 7, 2020 to Office Action mailed Feb. 17, 2020", With English translation of replacement pages of Specification, 166 pgs.
"Taiwanese Application Serial No. 110126544, Office Action mailed Sep. 10, 2021", With English translation, 5 pages.
"Taiwanese Application Serial No. 110126544, Response filed Dec. 3, 2021 to Office Action mailed Sep. 10, 2021", w/ English claims, 108 pgs.
"Taiwanese Application Serial No. 111116614, Office Action mailed Apr. 10, 2023", With English machine translation, 12 pgs.
"Taiwanese Application Serial No. 111116614, Response filed Jul. 10, 2023 to Office Action mailed Apr. 10, 2023", w English claims, 108 pgs.

(56) References Cited

OTHER PUBLICATIONS

"Taiwanese Application Serial No. 113100565, Office Action mailed Feb. 17, 2024", w English Translation, 3 pgs.
"Taiwanese Application Serial No. 113100565, Response filed May 3, 2024 to Office Action mailed Feb. 17, 2024", W English Claims, 109 pgs.

* cited by examiner

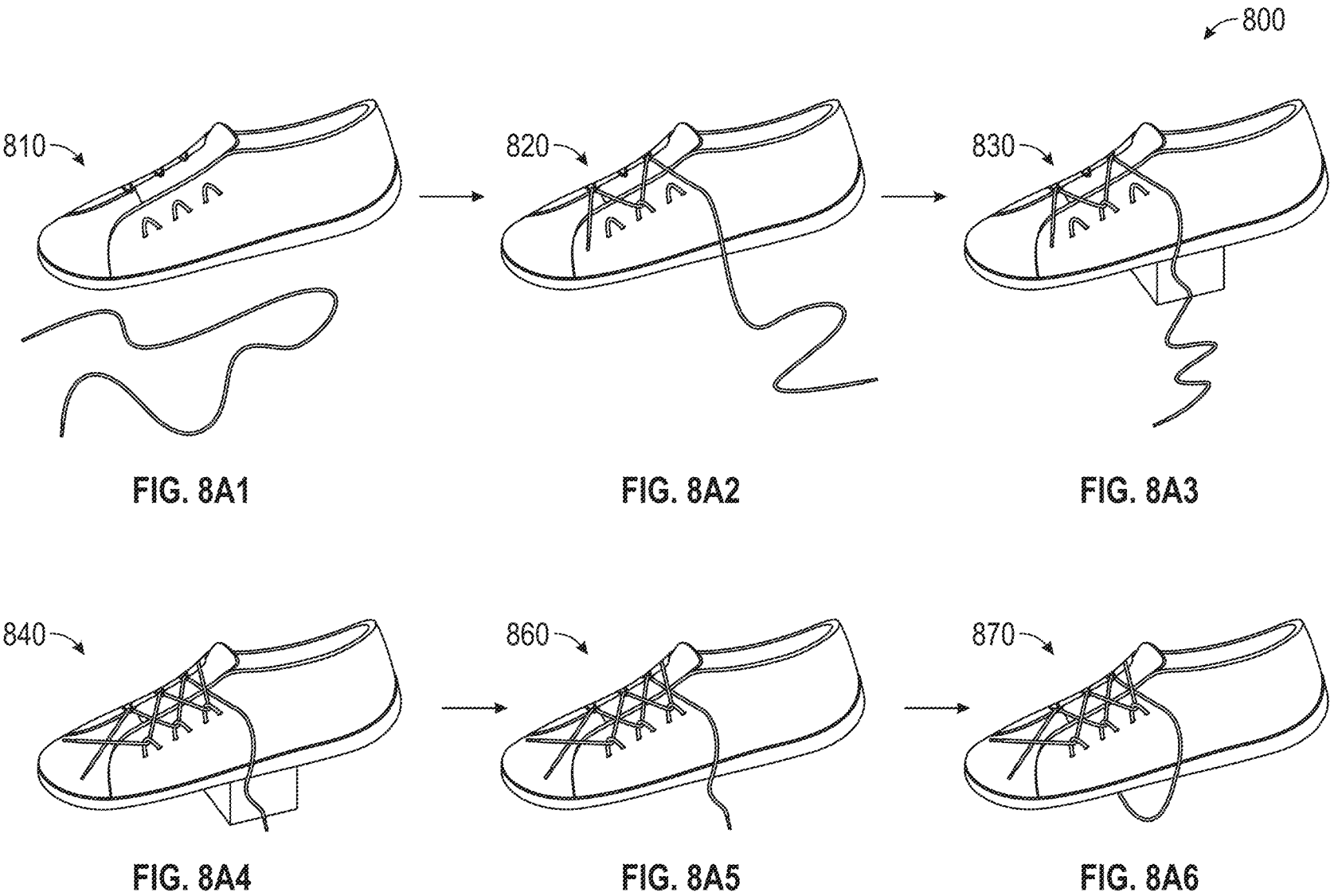
FIG. 8A1
FIG. 8A2
FIG. 8A3
FIG. 8A4
FIG. 8A5
FIG. 8A6

1100

Fixed segment concept:

- The idea is to dice up the total travel bigfoot has into a fixed number of segments.
- A segment is a defined amount of spool travel.
- Not all segments are the same amount and will likely depend on where the engine is on the scale.
- For example, the segments might have 10deg of spool travel when the shoe is at the loose end of the scale.
- A segment might be 2deg of spool travel when the shoe is at the tight end of the scale.
- Position is the primary input for the tightness setting, motor current is used secondarily or as a safety check.

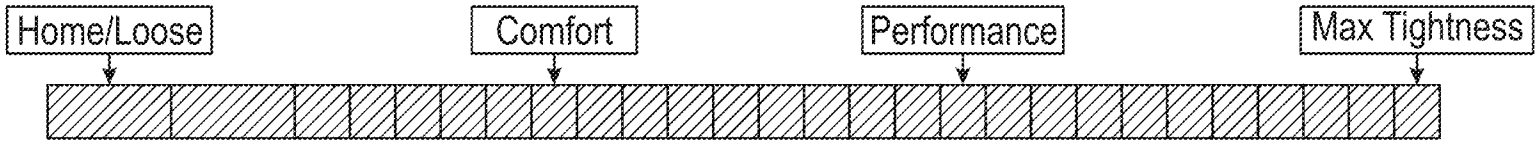

FIG. 11A

1100

Motion profile tables:

- We define a table of "moves".
- A motion profile is a collection of these moves.
- An autolace or a button press creates a series of these motion profiles.
- We control to a profile and demand a current to support it.
- This would be the spool motion profile.
- We would have a multiplier for the gear reduction (so we can change it quickly if needed).

| Move (spool) | Accel (deg/s/s) | Vel (deg/s) | Dec (deg/s/s) | Angle (deg) |
|---|---|---|---|---|
| Home to Comfort | 100 | 400 | 200 | 550 |
| Segment | 400 | 100 | 400 | 30 |
| Comfort to Performance | 100 | 400 | 200 | 550 |
| Relax | 50 | 5 | 50 | -5 |
| Return to home | 100 | 400 | 200 | 550 |
| Find home | 100 | 10 | | |
| Untangle 1 | | | | |

FIG. 11B

Motion profile tables:

- We define a table of "moves".
- A motion profile is a collection of these moves.
- An autolace or a button press creates a series of these motion profiles.
- We control to a profile and demand a current to support it.
- This would be the spool motion profile.
- We would have a multiplier for the gear reduction (so we can change it quickly if needed).

LACING ENGINE FOR AUTOMATED FOOTWEAR PLATFORM

CLAIM OF PRIORITY

This application is a continuation of U.S. patent application Ser. No. 16/740,749, filed Jan. 13, 2020, which application is a divisional application of U.S. patent application Ser. No. 15/945,797, filed Apr. 5, 2018, issued on Jan. 14, 2020 as U.S. Pat. No. 10,531,709, which application is a continuation of U.S. patent application Ser. No. 15/452,636, filed Mar. 7, 2017, issued on May 8, 2018 as U.S. Pat. No. 9,961,963, which application claims the benefit of priority of U.S. Provisional Patent Application Ser. No. 62/308,638, filed on Mar. 15, 2016, all of which are incorporated herein by reference in their entireties.

The following specification describes various aspects of a motorized lacing system, motorized and non-motorized lacing engines, footwear components related to the lacing engines, automated lacing footwear platforms, and related assembly processes.

BACKGROUND

Devices for automatically tightening an article of footwear have been previously proposed. Liu, in U.S. Pat. No. 6,691,433, titled "Automatic tightening shoe", provides a first fastener mounted on a shoe's upper portion, and a second fastener connected to a closure member and capable of removable engagement with the first fastener to retain the closure member at a tightened state. Liu teaches a drive unit mounted in the heel portion of the sole. The drive unit includes a housing, a spool rotatably mounted in the housing, a pair of pull strings and a motor unit. Each string has a first end connected to the spool and a second end corresponding to a string hole in the second fastener. The motor unit is coupled to the spool. Liu teaches that the motor unit is operable to drive rotation of the spool in the housing to wind the pull strings on the spool for pulling the second fastener towards the first fastener. Liu also teaches a guide tube unit that the pull strings can extend through.

Overview

The present inventors have recognized, among other things, a need for improved modular lacing engine for automated and semi-automated tightening of shoe laces. This document describes, among other things, the mechanical design of a modular lacing engine and associated footwear components. The following examples provide a non-limiting overview of the modular lacing engine and supporting footwear components discussed herein.

Example 1 describes subject matter including a modular footwear apparatus. The modular footwear apparatus can comprise an upper portion, a lower portion, and a lacing engine. The upper portion can include a lace to adjust fit of the upper portion against a foot, the lace adjustable between a first position and a second position based at least in part on manipulation of an effective length of the lace. The lower portion can include a mid-sole and an out-sole. Additionally, the lower portion can be coupled to the upper portion at the mid-sole. The lacing engine can include a top-loading lace spool to engage a loop of the lace to enable manipulation of the effective length of the lace through rotation of the lace spool, the lacing engine can be received within a cavity in the lower portion of the footwear apparatus.

In Example 2, the subject matter of Example 1 can optionally include the cavity in the lower portion being adapted to removably receive the lacing engine.

In Example 3, the subject matter of any one of Examples 1 and 2 can optionally include the top-loading spool having a lace groove running across a diameter of the spool to receive the loop of the lace.

In Example 4, the subject matter of any one of Examples 1 to 3 can optionally include the lacing engine having a top section with a lace channel running in a medial-lateral direction in alignment with the top-loading lace spool.

In Example 5, the subject matter of Example 4 can optionally include the lace channel having a medial portion on a medial side of the top-loading lace spool and a lateral portion on a lateral side of the top-loading lace spool.

In Example 6, the subject matter of Example 5, can optionally include the medial portion and the lateral portion of the lace channel transitioning into a spool recess.

In Example 7, the subject matter of Example 6 can optionally include the spool recess having opposing semi-circular sections corresponding to portions of an outer diameter of a superior surface of the top-loading lace spool.

In Example 8, the subject matter of Example 7 can optionally include the top-loading lace spool having a reduced diameter section below the superior surface that works in conjunction with the spool recess to create a lace recess to accommodate a portion of the lace as the lace is taken up on the top-loading lace spool.

In Example 9, the subject matter of claim any one of Examples 1 to 8 can optionally include the lacing engine having a top surface with a generally circular recess to expose a superior surface of the top-loading lace spool, the superior surface of the top-loading lace spool bisected into two semicircular portions by a lace groove.

In Example 10, the subject matter of Example 9 can optionally include the lace groove bisecting the superior surface of the top-loading spool into a reduced diameter spool portion adapted to receive the lace as the top-loading spool is rotated in a first direction.

In Example 11, the subject matter of any one of Examples 1 to 10 can optionally include the mid-sole having a mid-sole plate to receive the lacing engine.

In Example 12, the subject matter of Example 11 can optionally include the mid-sole plate being formed of a substantially more rigid material than the reminder of the lower portion.

In Example 13, the subject matter of any one of Examples 11 and 12 can optionally include the mid-sole plate having a medial lace guide and a lateral lace guide.

In Example 14, the subject matter of any one of Examples 11 to 13 can optionally include the mid-sole plate having an anterior flange and a posterior flange to stabilize the mid-sole plate within the lower portion.

In Example 15, the subject matter of any one of Examples 11 to 14 can optionally include the mid-sole plate having a medial lid slot, a lateral lid slot, and a lid latch recess to receive and secure a lid.

In Example 16, the subject matter of Example 15 can optionally include the lid once secured to the mid-sole plate can retain the lacing engine within the cavity in the mid-sole plate.

In Example 17, the subject matter of any one of Examples 1 to 16 can optionally include the upper portion having a medial opening, wherein at least a portion of the lace spans the medial opening.

In Example 18, the subject matter of any one of Examples 1 to 16 can optionally include the upper portion being formed of a continuous piece of knit fabric.

In Example 19, the subject matter of any one of Examples 17 and 18 can optionally include the lace being fixed in a first location and a second location on the upper portion.

In Example 20, the subject matter of Example 19 can optionally include the lace being routed through a plurality of lace guides affixed to or integrated into the upper portion.

Example 21 describes a modular lacing engine. In this example, the modular lacing engine can include a housing, a lace spool, and a worm gear. The housing can include a superior section and an inferior section, the superior section can include a lace channel and a spool recess. The superior section and the inferior section can create an internal space within the housing to contain components of the modular lacing engine. The lace spool can be disposed within the spool recess in the superior section of the housing. The lace spool including a lace grove in a superior surface to receive a lace cable and a spool shaft extending inferiorly through the superior section into an interior space of the housing. The worm gear can be coupled to an inferior end of the spool shaft, and configured to receive input from a drive system within the housing to rotate the lace spool to take up the lace cable on the lace spool as the lace spool rotates in a first direction.

In Example 22, the subject matter of Example 21 can optionally include the drive system having a worm drive to engage the worm gear, and a gear motor coupled to the worm drive.

In Example 23, the subject matter of Example 22 can optionally include the gear motor being coupled to the worm drive via a gear box.

In Example 24, the subject matter of Example 22 can optionally include the worm drive being positioned relative to the worm gear to transfer loads generated by tension on the lace cable and transmitted to the worm drive by the worm gear away from the gear motor.

In Example 25, the subject matter of Example 24 can optionally include the worm drive being coupled opposite the gear motor to a bushing to absorb the loads generated by tension on the lace cable and transmitted to the worm drive by the worm gear disposed on the spool shaft.

In Example 26, the subject matter of any one of Examples 21 to 24 can optionally include the spool recess having opposing semi-circular sections corresponding to portions of an outer diameter of a superior surface of the top-loading lace spool.

In Example 27, the subject matter of Example 26 can optionally include the lace spool having a reduced diameter section below the superior surface that works in conjunction with the spool recess to create a lace recess to accommodate a portion of the lace as the lace is taken up on the lace spool.

In Example 28, the subject matter of any one of Examples 21 to 27 can optionally include the lace spool, lace grove, and spool shaft being formed from a single piece of material.

In Example 29, the subject matter of any one of Examples 21 to 28 can optionally include the lace shaft being coupled to the worm gear through a clutch system that allows the lace spool is rotate freely when deactivated.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIGS. 8A1-8A6 and 8B are drawings and a flowchart illustrating an assembly process for assembly of a footwear upper in preparation for assembly to mid-sole, according to some example embodiments.

FIG. 11A-11D are diagrams illustrating a motor control scheme for a motorized lacing engine, according to some example embodiments.

Figure 1:
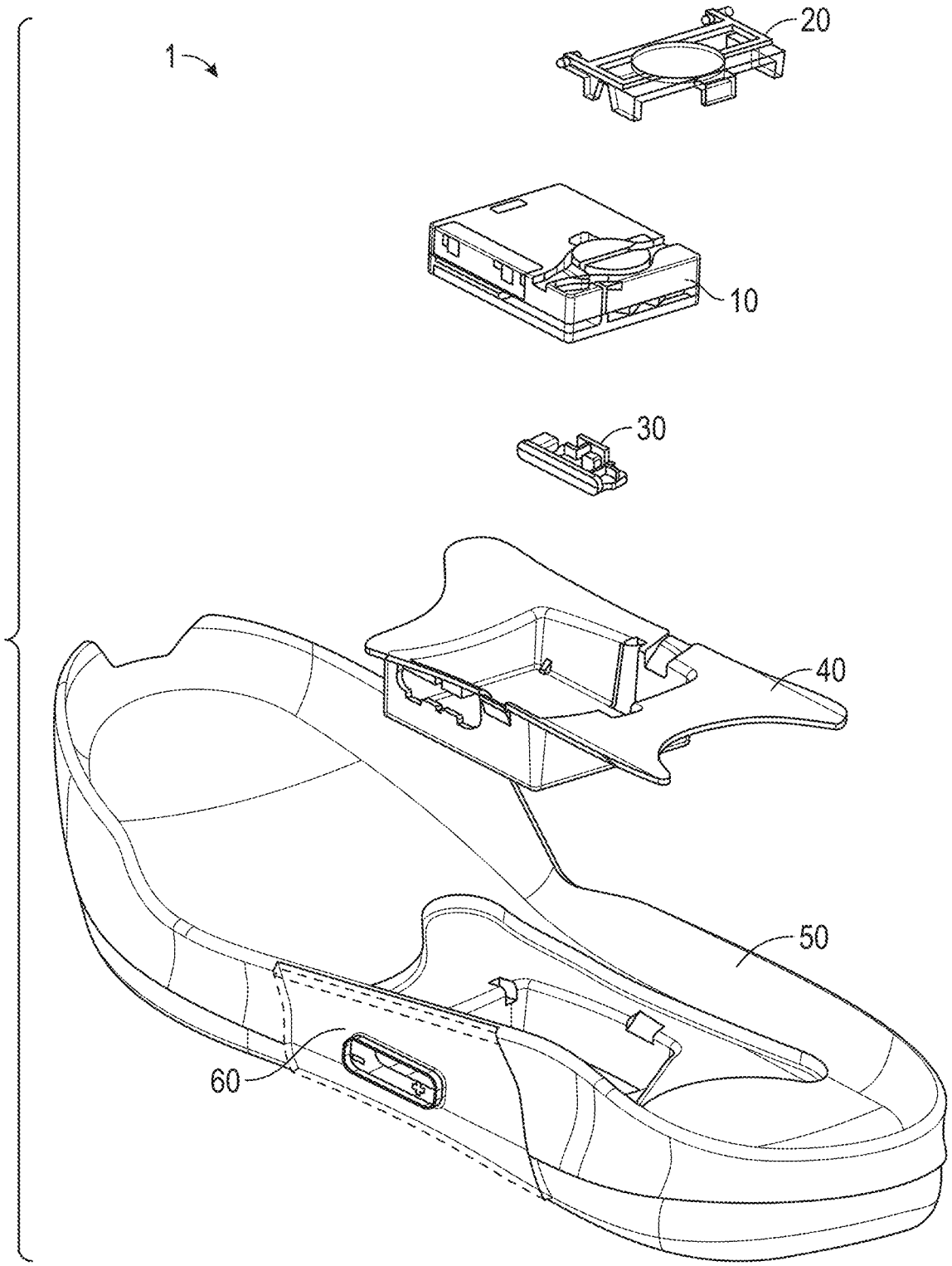
FIG. 1 is an exploded view illustration of components of a motorized lacing system, according to some example embodiments.

The headings provided herein are merely for convenience and do not necessarily affect the scope or meaning of the terms used.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed in these early versions do not necessarily lend themselves to mass production or daily use. Additionally, previous designs for motorized lacing systems comparatively suffered from problems such as high cost of manufacture, complexity, assembly challenges, lack of serviceability, and weak or fragile mechanical mechanisms, to highlight just a few of the many issues. The present inventors have developed a modular footwear platform to accommodate motorized and non-motorized lacing engines that solves some or all of the problems discussed above, among others. The components discussed below provide various benefits including, but not limited to: serviceable components, interchangeable automated lacing engines, robust mechanical design, reliable operation, streamlined assembly processes, and retail-level customization. Various other benefits of the components described below will be evident to persons of skill in the relevant arts.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, the modular automated lacing footwear platform includes a mid-sole plate secured to the mid-sole for receiving a lacing engine. The design of the mid-sole plate allows a lacing engine to be dropped into the footwear platform as late as at a point of purchase. The mid-sole plate, and other aspects of the modular automated footwear platform, allow for different types of lacing engines to be used interchangeably. For example, the motorized lacing engine discussed below could be changed out for a human-powered lacing engine. Alternatively, a fully-automatic motorized lacing engine with foot presence sensing or other optional features could be accommodated within the standard mid-sole plate.

The automated footwear platform discussed herein can include an outsole actuator interface to provide tightening control to the end user as well as visual feedback through LED lighting projected through translucent protective outsole materials. The actuator can provide tactile and visual feedback to the user to indicate status of the lacing engine or other automated footwear platform components.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on a motorized lacing engine, many of the mechanical aspects of the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-power, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

Figure 2A:
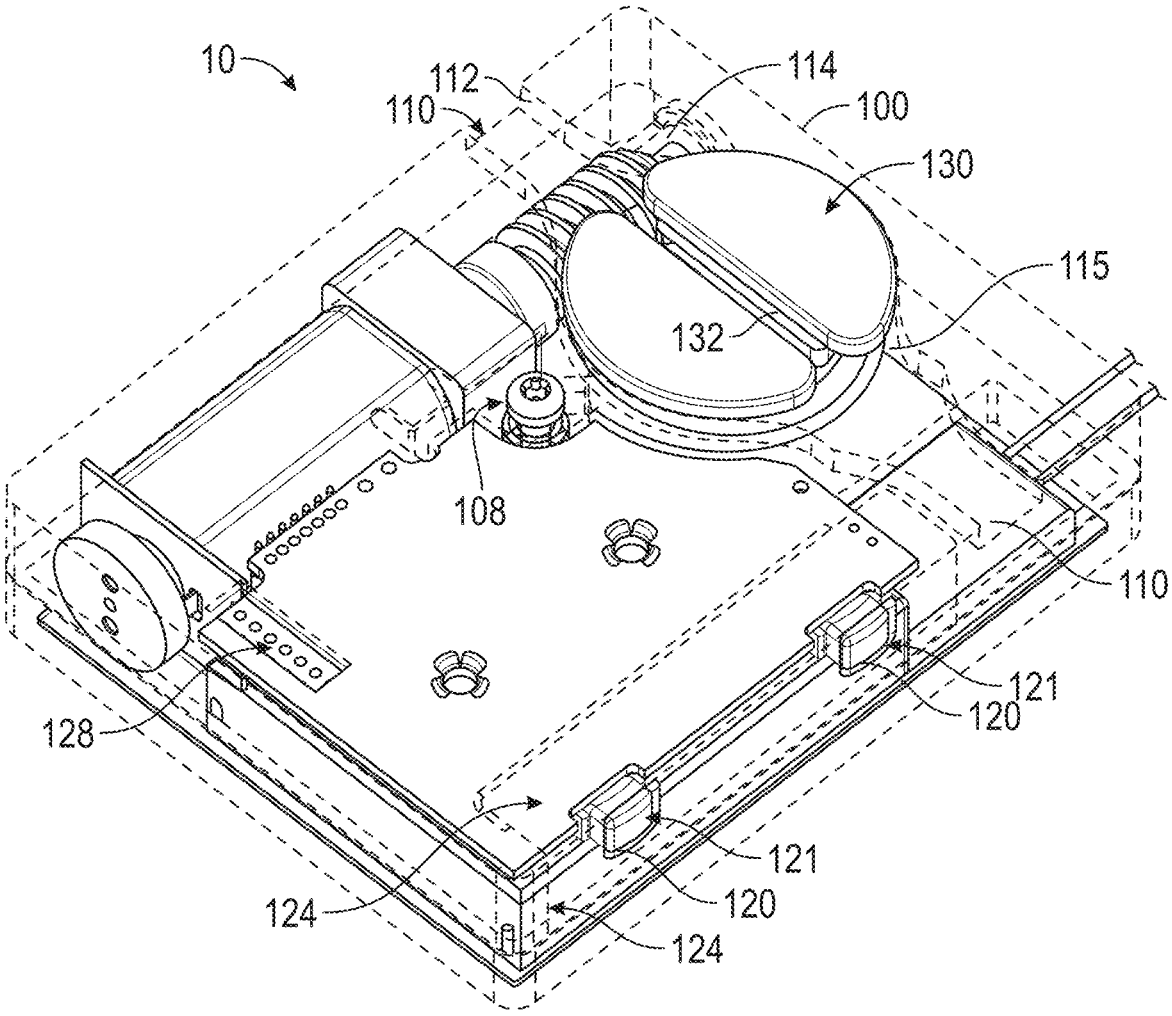
FIGS. 2A-2N are diagrams and drawings illustrating a motorized lacing engine, according to some example embodiments.
Figure 2B:
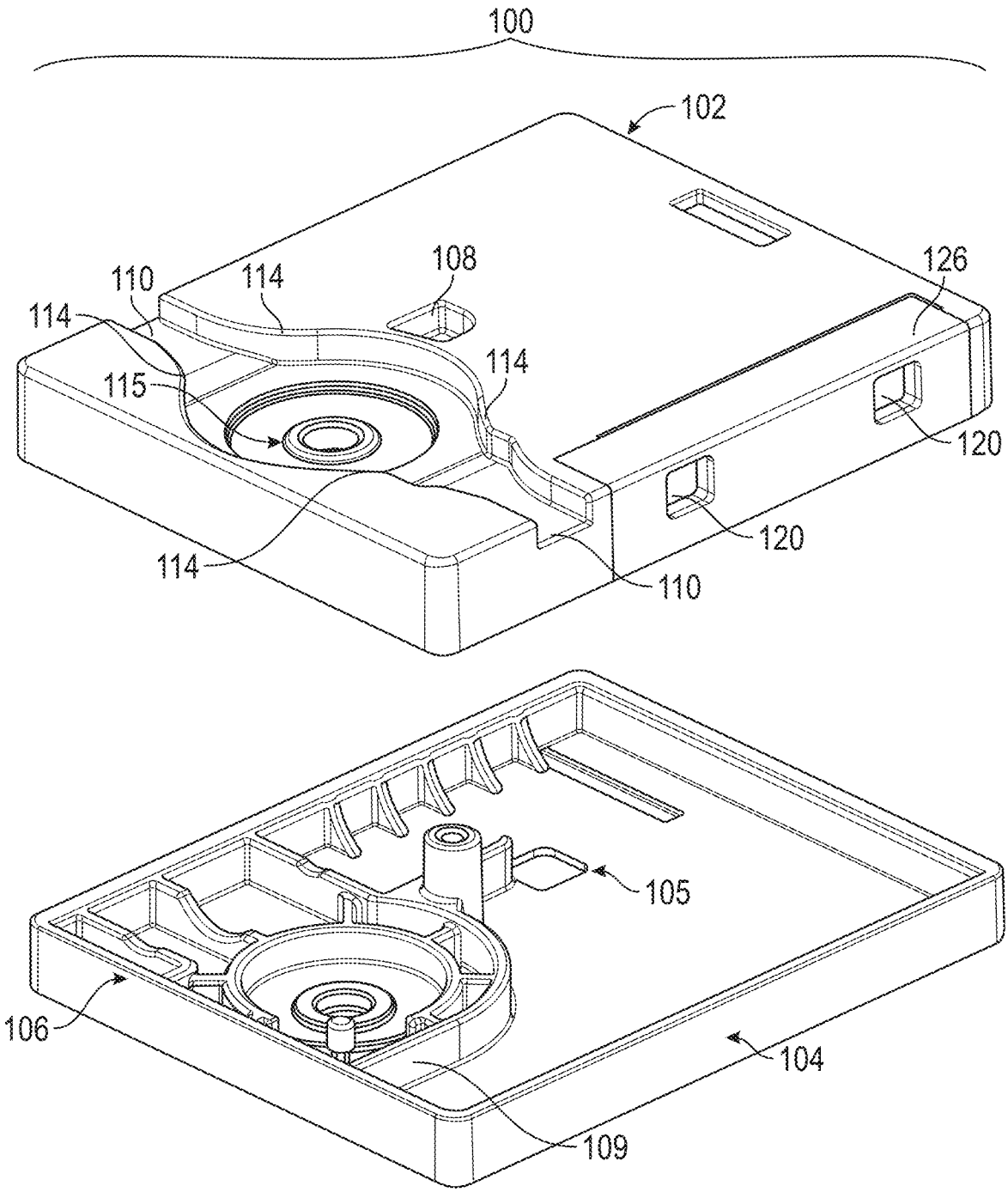
Figure 2C:
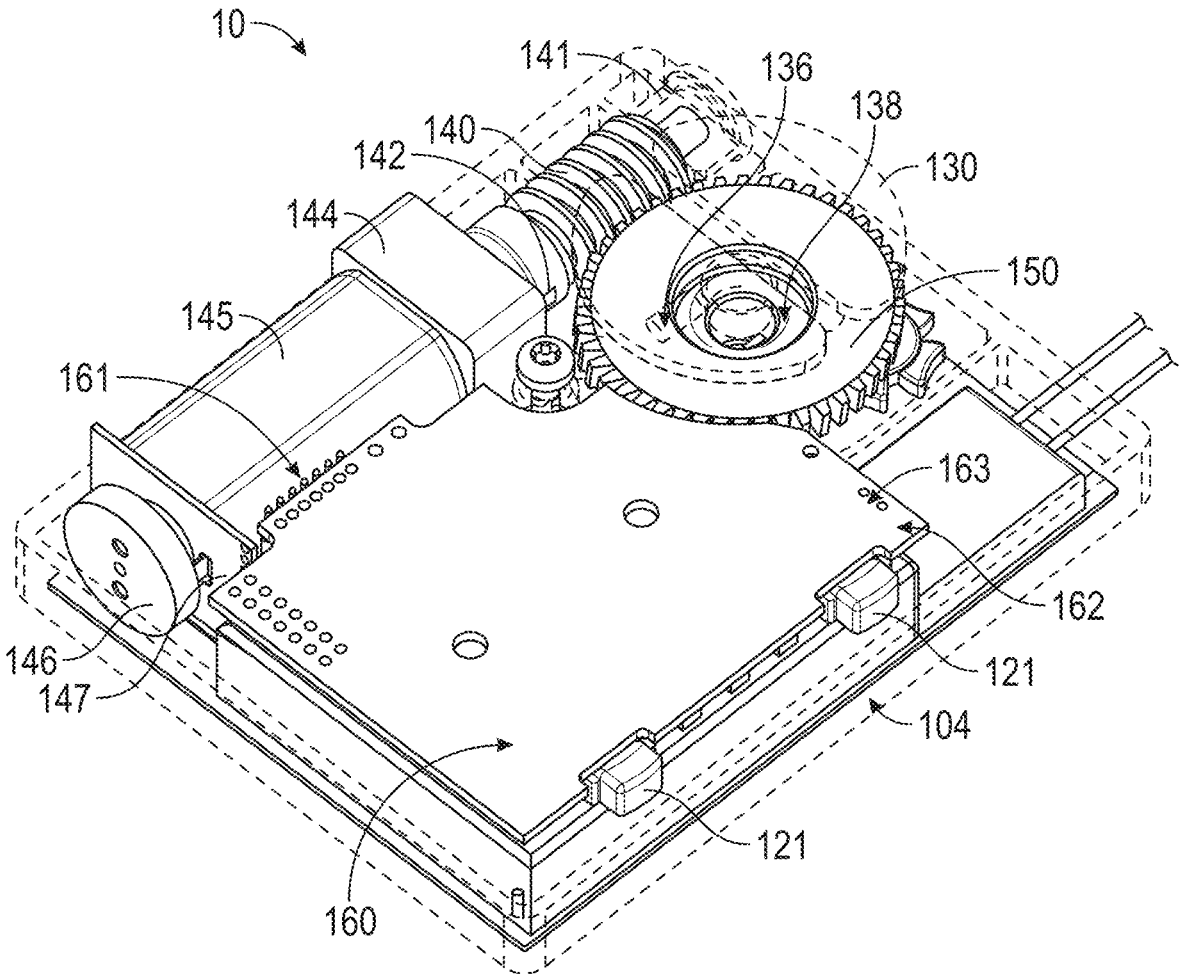
Figure 2D:
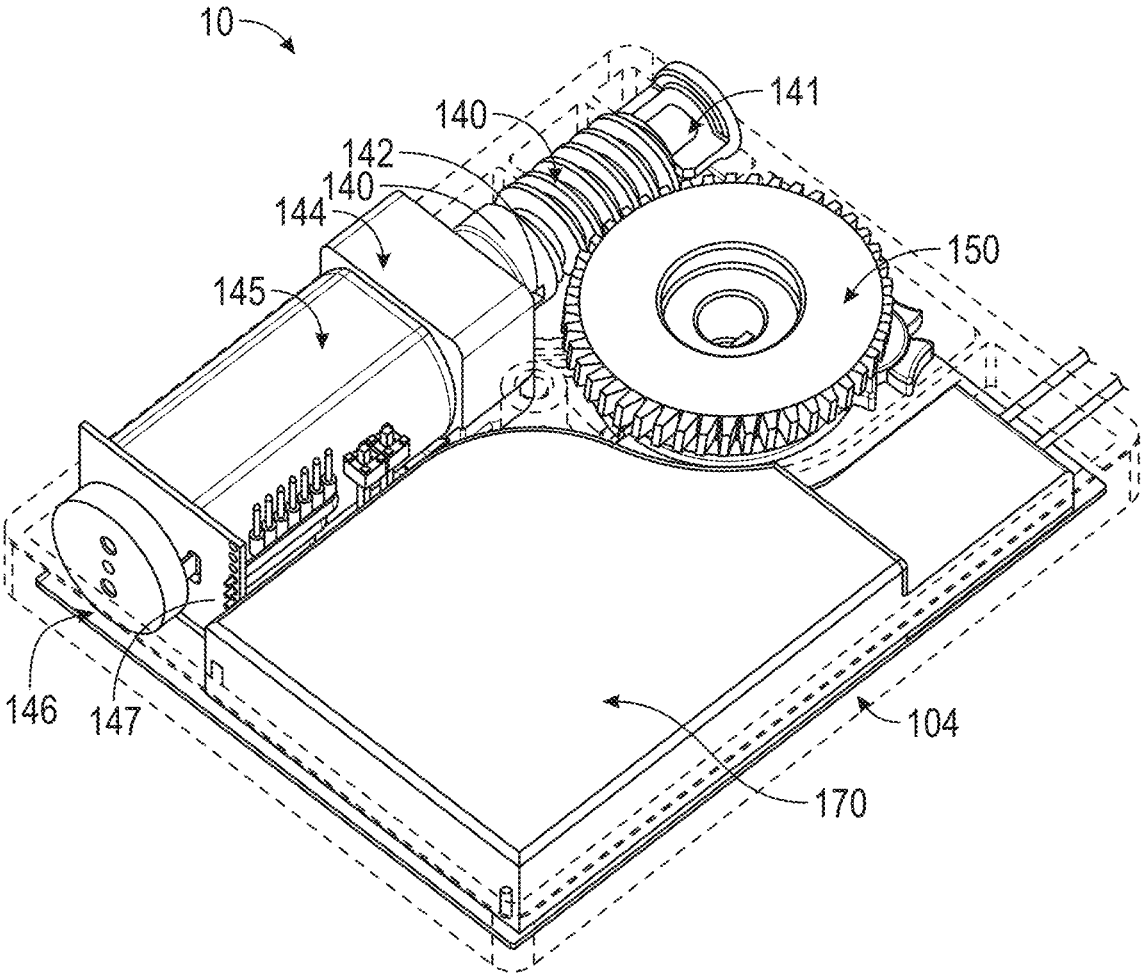
Figure 2E:
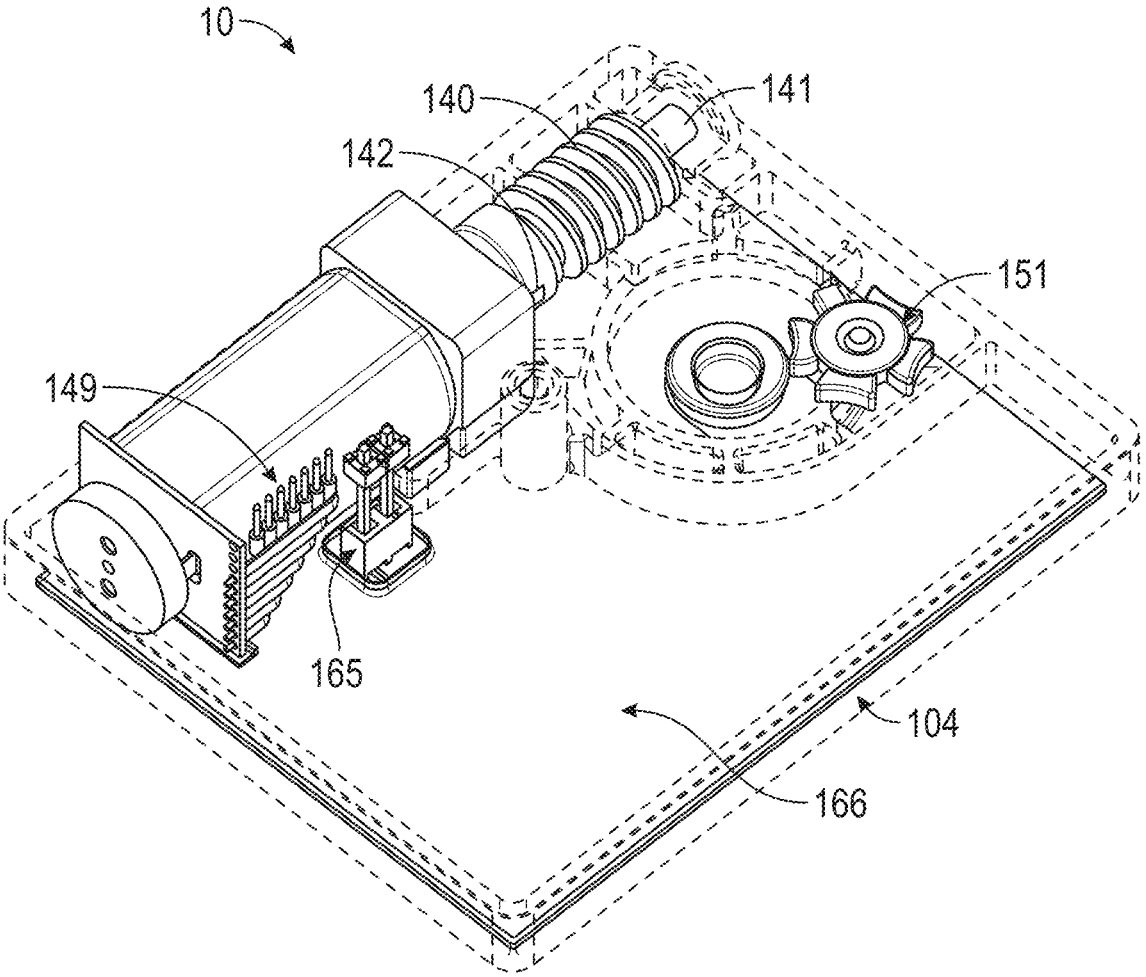
Figure 2F:
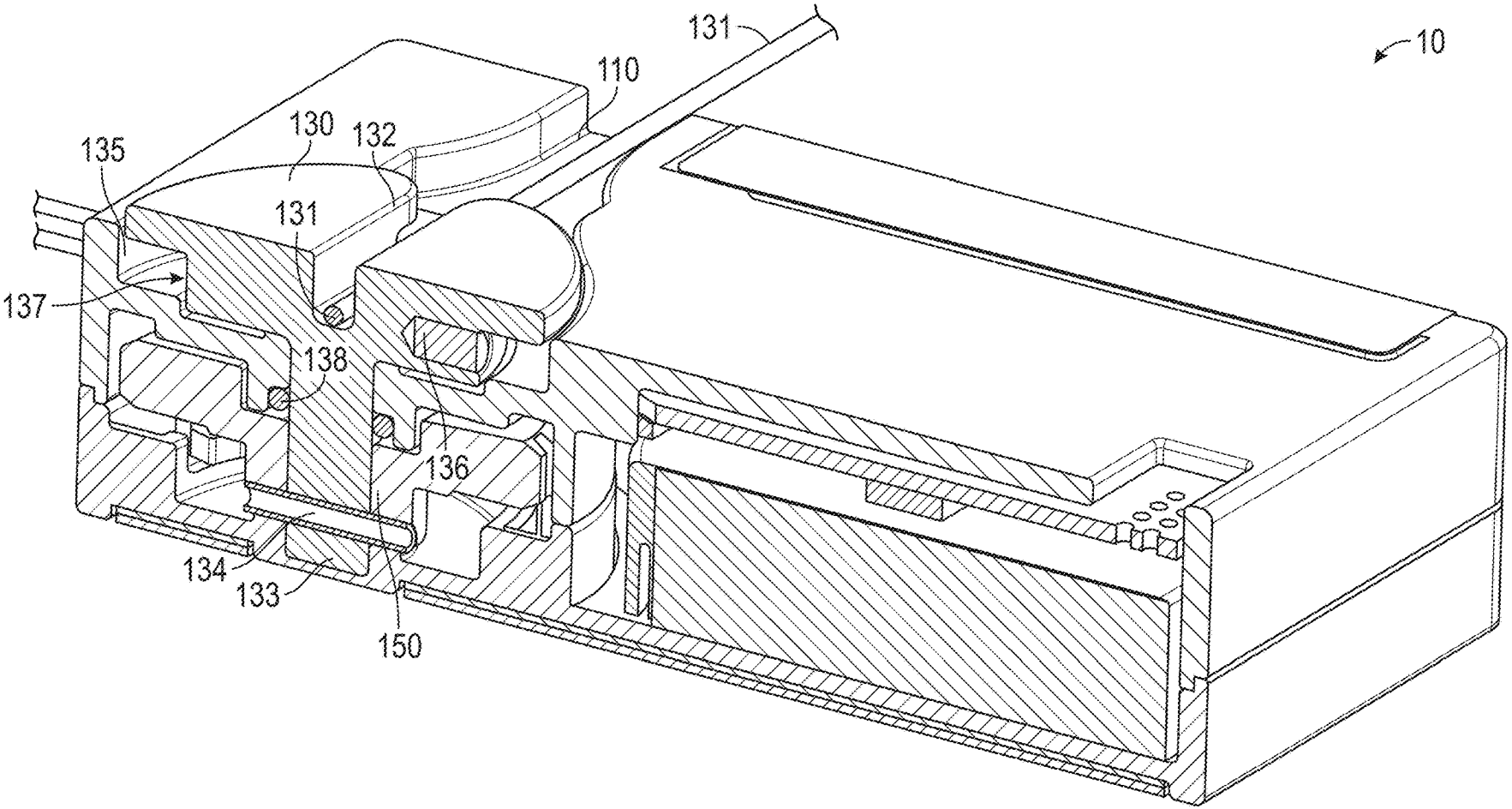
Figure 2G:
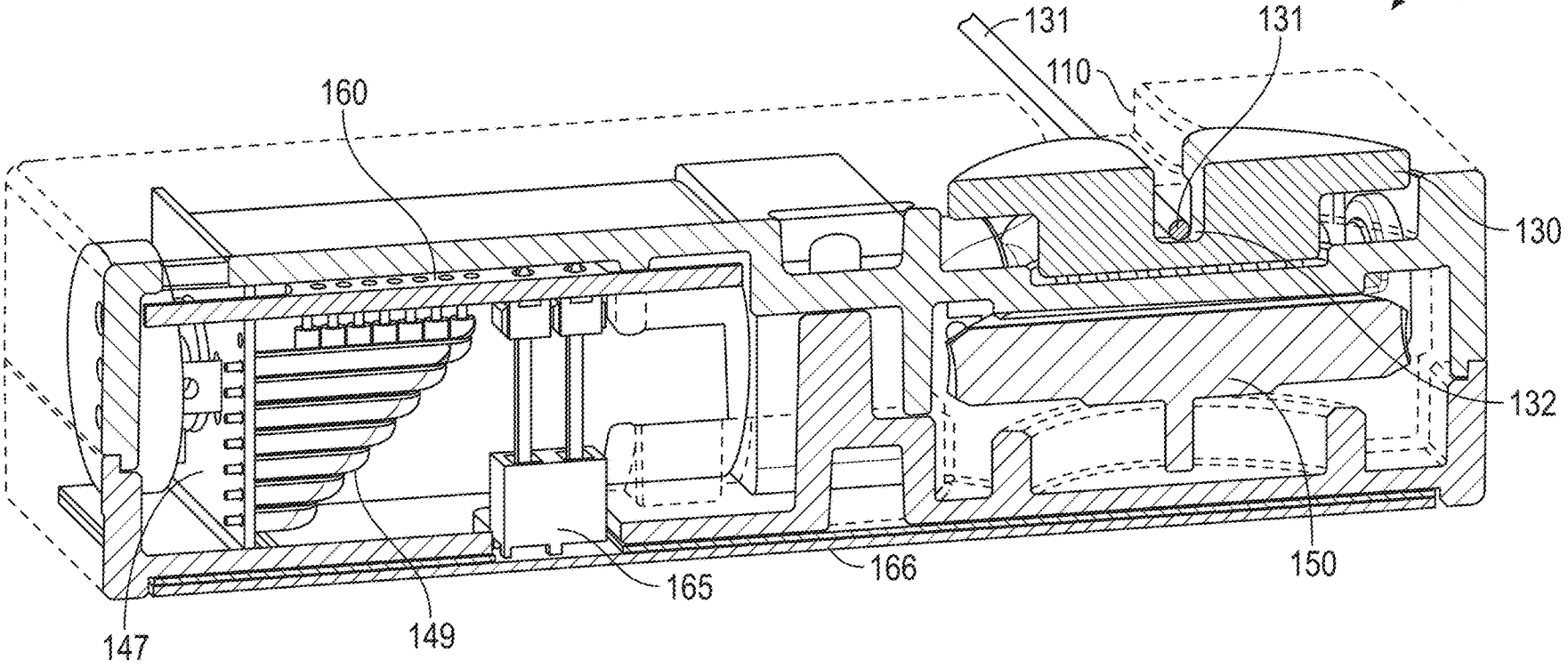
Figure 2H:
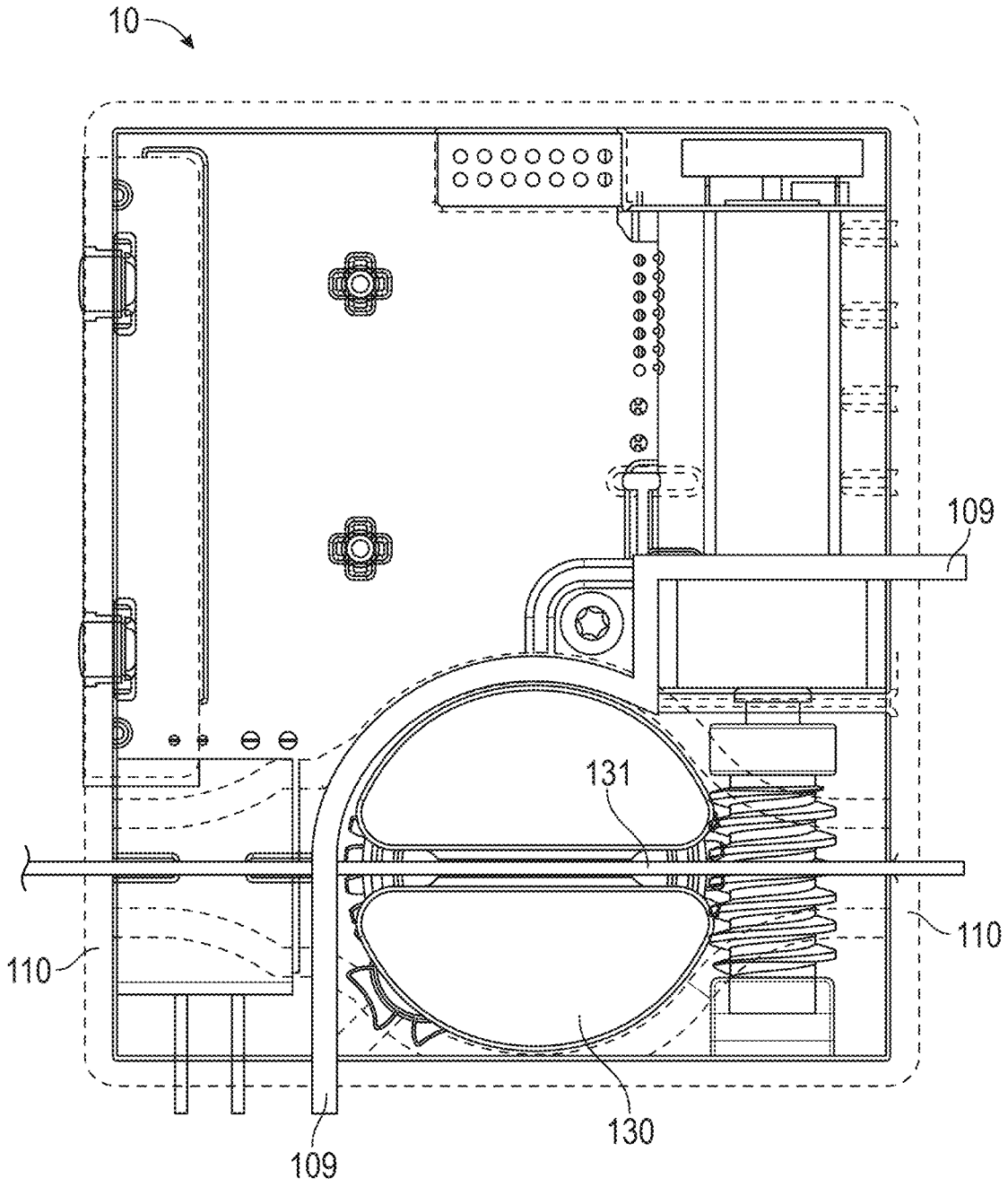
Figure 2I:
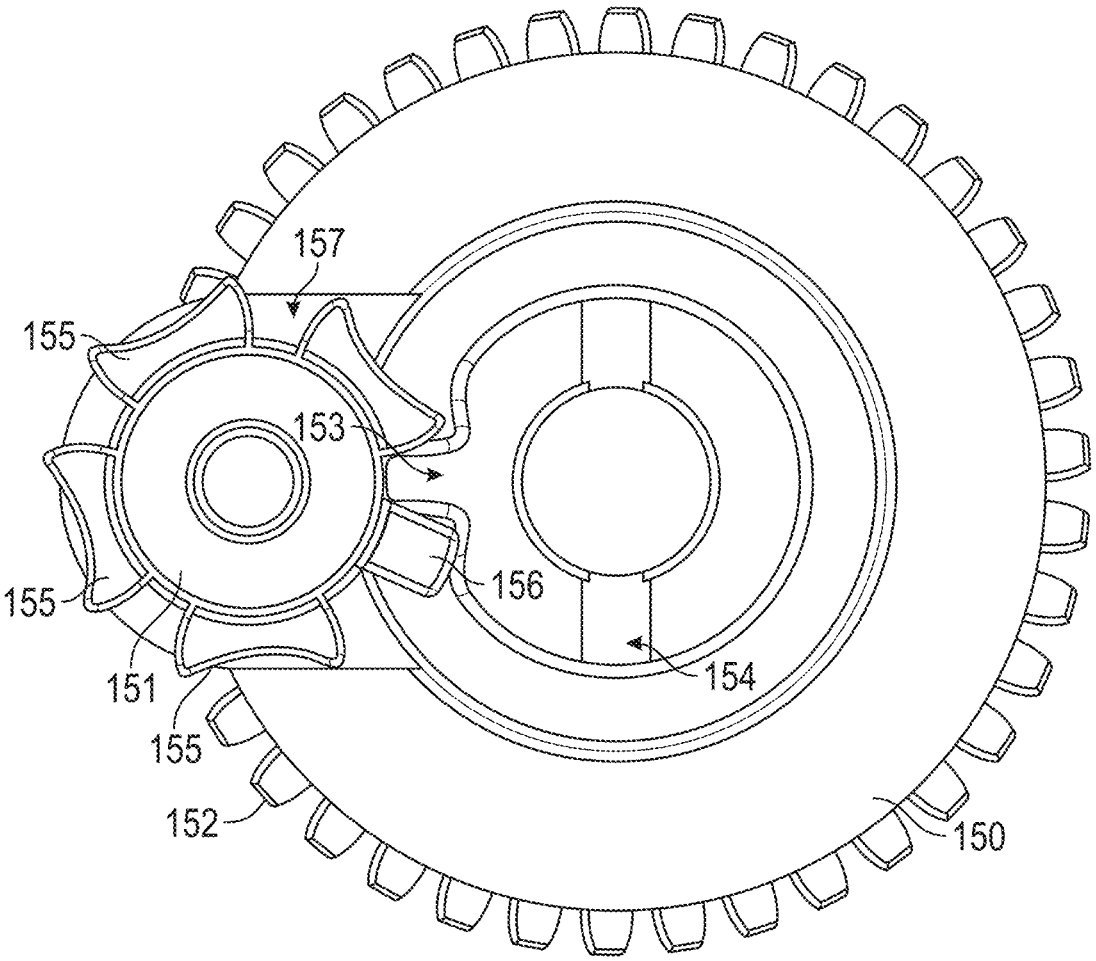
Figure 2J:
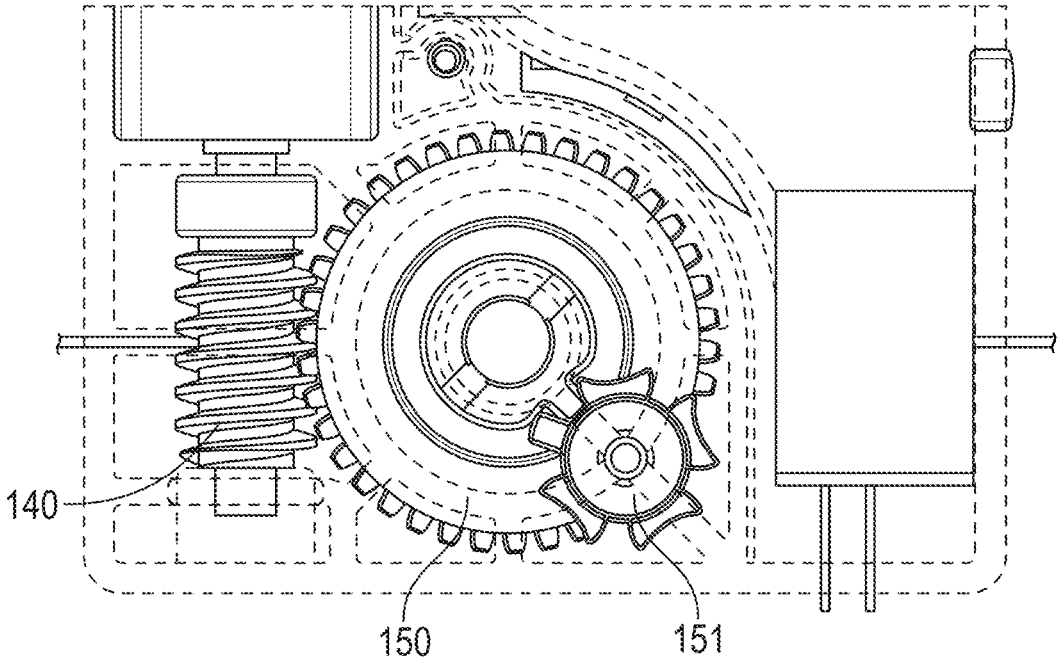
Figure 2K:
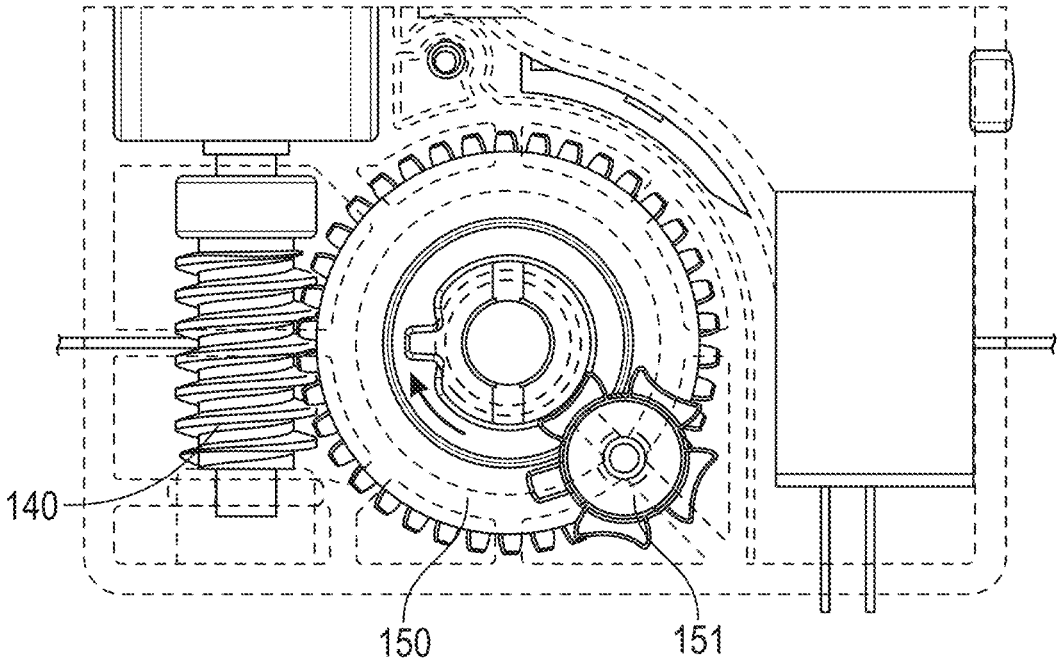
Figure 2L:
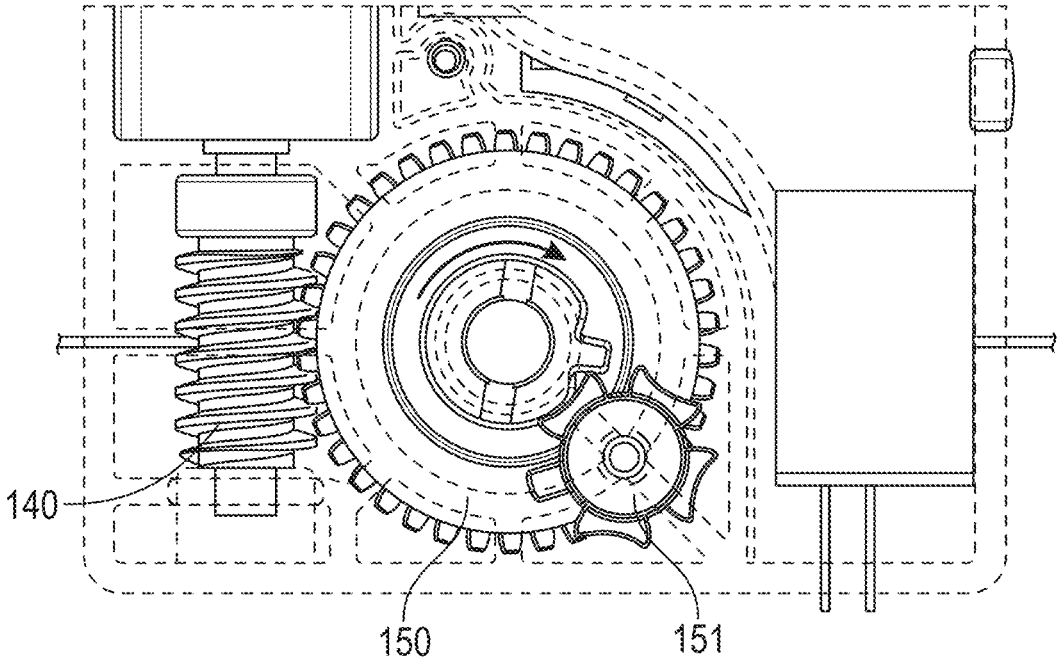
Figure 2M:
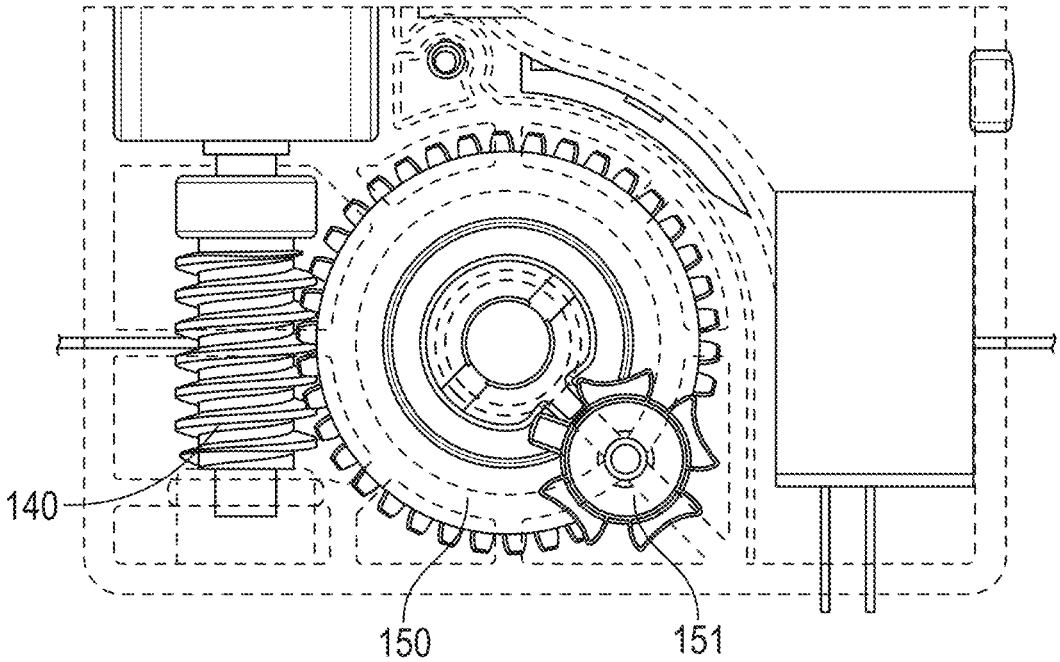
Figure 2N:
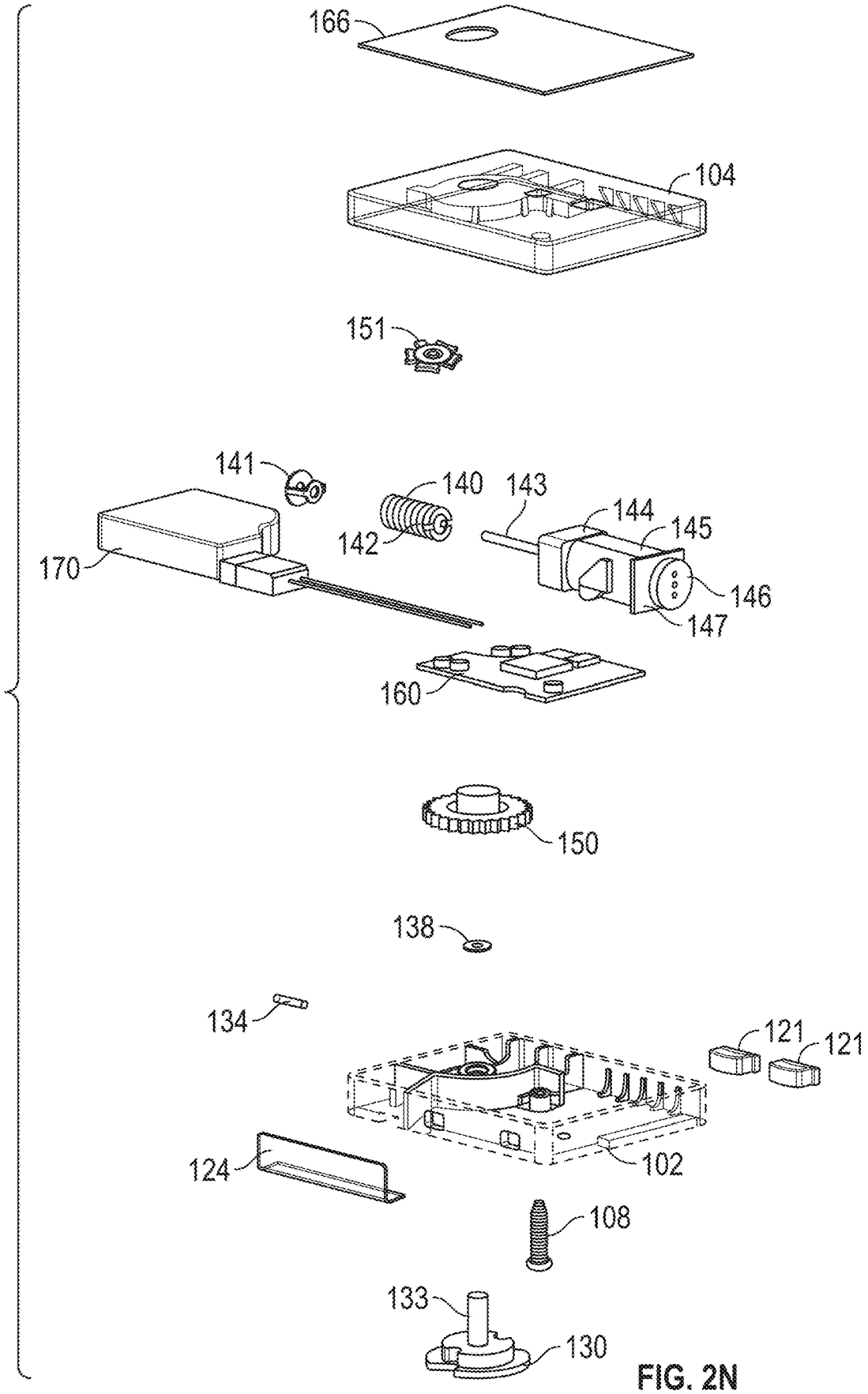

Examples of the lacing engine 10 are described in detail in reference to FIGS. 2A-2N. Examples of the actuator 30 are described in detail in reference to FIGS. 3A-3D. Examples of the mid-sole plate 40 are described in detail in reference to FIGS. 4A-4D. Various additional details of the motorized lacing system 1 are discussed throughout the remainder of the description.

FIGS. 2A-2N are diagrams and drawings illustrating a motorized lacing engine, according to some example embodiments. FIG. 2A introduces various external features of an example lacing engine 10, including a housing structure 100, case screw 108, lace channel 110 (also referred to as lace guide relief 110), lace channel wall 112, lace channel transition 114, spool recess 115, button openings 120, buttons 121, button membrane seal 124, programming header 128, spool 130, and lace grove 132. Additional details of the housing structure 100 are discussed below in reference to FIG. 2B.

In an example, the lacing engine 10 is held together by one or more screws, such as the case screw 108. The case screw 108 is positioned near the primary drive mechanisms to enhance structural integrity of the lacing engine 10. The case screw 108 also functions to assist the assembly process, such as holding the case together for ultra-sonic welding of exterior seams.

In this example, the lacing engine 10 includes a lace channel 110 to receive a lace or lace cable once assembled into the automated footwear platform. The lace channel 110 can include a lace channel wall 112. The lace channel wall 112 can include chamfered edges to provide a smooth guiding surface for a lace cable to run in during operation. Part of the smooth guiding surface of the lace channel 110 can include a channel transition 114, which is a widened portion of the lace channel 110 leading into the spool recess 115. The spool recess 115 transitions from the channel transition 114 into generally circular sections that conform closely to the profile of the spool 130. The spool recess 115 assists in retaining the spooled lace cable, as well as in retaining position of the spool 130. However, other aspects of the design provide primary retention of the spool 130. In this example, the spool 130 is shaped similarly to half of a yo-yo with a lace grove 132 running through a flat top surface and a spool shaft 133 (not shown in FIG. 2A)

extending inferiorly from the opposite side. The spool 130 is described in further detail below in reference of additional figures.

The lateral side of the lacing engine 10 includes button openings 120 that enable buttons 121 for activation of the mechanism to extend through the housing structure 100. The buttons 121 provide an external interface for activation of switches 122, illustrated in additional figures discussed below. In some examples, the housing structure 100 includes button membrane seal 124 to provide protection from dirt and water. In this example, the button membrane seal 124 is up to a few mils (thousandth of an inch) thick clear plastic (or similar material) adhered from a superior surface of the housing structure 100 over a corner and down a lateral side. In another example, the button membrane seal 124 is a 2 mil thick vinyl adhesive backed membrane covering the buttons 121 and button openings 120.

FIG. 2B is an illustration of housing structure 100 including top section 102 and bottom section 104. In this example, the top section 102 includes features such as the case screw 108, lace channel 110, lace channel transition 114, spool recess 115, button openings 120, and button seal recess 126. The button seal recess 126 is a portion of the top section 102 relieved to provide an inset for the button membrane seal 124. In this example, the button seal recess 126 is a couple mil recessed portion on the lateral side of the superior surface of the top section 104 transitioning over a portion of the lateral edge of the superior surface and down the length of a portion of the lateral side of the top section 104.

In this example, the bottom section 104 includes features such as wireless charger access 105, joint 106, and grease isolation wall 109. Also illustrated, but not specifically identified, is the case screw base for receiving case screw 108 as well as various features within the grease isolation wall 109 for holding portions of a drive mechanism. The grease isolation wall 109 is designed to retain grease or similar compounds surrounding the drive mechanism away from the electrical components of the lacing engine 10 including the gear motor and enclosed gear box. In this example, the worm gear 150 and worm drive 140 are contained within the grease isolation wall 109, while other drive components such as gear box 144 and gear motor 145 are outside the grease isolation wall 109. Positioning of the various components can be understood through a comparison of FIG. 2B with FIG. 2C, for example.

FIG. 2C is an illustration of various internal components of lacing engine 10, according to example embodiments. In this example, the lacing engine 10 further includes spool magnet 136, O-ring seal 138, worm drive 140, bushing 141, worm drive key 142, gear box 144, gear motor 145, motor encoder 146, motor circuit board 147, worm gear 150, circuit board 160, motor header 161, battery connection 162, and wired charging header 163. The spool magnet 136 assists in tracking movement of the spool 130 though detection by a magnetometer (not shown in FIG. 2C). The o-ring seal 138 functions to seal out dirt and moisture that could migrate into the lacing engine 10 around the spool shaft 133.

In this example, major drive components of the lacing engine 10 include worm drive 140, worm gear 150, gear motor 145 and gear box 144. The worm gear 150 is designed to inhibit back driving of worm drive 140 and gear motor 145, which means the major input forces coming in from the lacing cable via the spool 130 are resolved on the comparatively large worm gear and worm drive teeth. This arrangement protects the gear box 144 from needing to include gears of sufficient strength to withstand both the dynamic loading from active use of the footwear platform or tightening loading from tightening the lacing system. The worm drive 140 includes additional features to assist in protecting the more fragile portions of the drive system, such as the worm drive key 142. In this example, the worm drive key 142 is a radial slot in the motor end of the worm drive 140 that interfaces with a pin through the drive shaft coming out of the gear box 144. This arrangement prevents the worm drive 140 from imparting any axial forces on the gear box 144 or gear motor 145 by allowing the worm drive 140 to move freely in an axial direction (away from the gear box 144) transferring those axial loads onto bushing 141 and the housing structure 100.

FIG. 2D is an illustration depicting additional internal components of the lacing engine 10. In this example, the lacing engine 10 includes drive components such as worm drive 140, bushing 141, gear box 144, gear motor 145, motor encoder 146, motor circuit board 147 and worm gear 150. FIG. 2D adds illustration of battery 170 as well as a better view of some of the drive components discussed above.

FIG. 2E is another illustration depicting internal components of the lacing engine 10. In FIG. 2E the worm gear 150 is removed to better illustrate the indexing wheel 151 (also referred to as the Geneva wheel 151). The indexing wheel 151, as described in further detail below, provides a mechanism to home the drive mechanism in case of electrical or mechanical failure and loss of position. In this example, the lacing engine 10 also includes a wireless charging interconnect 165 and a wireless charging coil 166, which are located inferior to the battery 170 (which is not shown in this figure). In this example, the wireless charging coil 166 is mounted on an external inferior surface of the bottom section 104 of the lacing engine 10.

FIG. 2F is a cross-section illustration of the lacing engine 10, according to example embodiments. FIG. 2F assists in illustrating the structure of the spool 130 as well as how the lace grove 132 and lace channel 110 interface with lace cable 131. As shown in this example, lace 131 runs continuously through the lace channel 110 and into the lace grove 132 of the spool 130. The cross-section illustration also depicts lace recess 135 and spool mid-section, which are where the lace 131 will build up as it is taken up by rotation of the spool 130. The spool mid-section 137 is a circular reduced diameter section disposed inferiorly to the superior surface of the spool 130. The lace recess 135 is formed by a superior portion of the spool 130 that extends radially to substantially fill the spool recess 115, the sides and floor of the spool recess 115, and the spool mid-section 137. In some examples, the superior portion of the spool 130 can extend beyond the spool recess 115. In other examples, the spool 130 fits entirely within the spool recess 115, with the superior radial portion extending to the sidewalls of the spool recess 115, but allowing the spool 130 to freely rotation with the spool recess 115. The lace 131 is captured by the lace groove 132 as it runs across the lacing engine 10, so that when the spool 130 is turned, the lace 131 is rotated onto a body of the spool 130 within the lace recess 135.

As illustrated by the cross-section of lacing engine 10, the spool 130 includes a spool shaft 133 that couples with worm gear 150 after running through an O-ring 138. In this example, the spool shaft 133 is coupled to the worm gear via keyed connection pin 134. In some examples, the keyed connection pin 134 only extends from the spool shaft 133 in one axial direction, and is contacted by a key on the worm gear in such a way as to allow for an almost complete revolution of the worm gear 150 before the keyed connection pin 134 is contacted when the direction of worm gear 150 is reversed. A clutch system could also be implemented to couple the spool 130 to the worm gear 150. In such an example, the clutch mechanism could be deactivated to allow the spool 130 to run free upon de-lacing (loosening). In the example of the keyed connection pin 134 only extending is one axial direction from the spool shaft 133, the spool is allowed to move freely upon initial activation of a de-lacing process, while the worm gear 150 is driven backward. Allowing the spool 130 to move freely during the initial portion of a de-lacing process assists in preventing tangles in the lace 131 as it provides time for the user to begin loosening the footwear, which in turn will tension the lace 131 in the loosening direction prior to being driven by the worm gear 150.

FIG. 2G is another cross-section illustration of the lacing engine 10, according to example embodiments. FIG. 2G illustrates a more medial cross-section of the lacing engine 10, as compared to FIG. 2F, which illustrates additional components such as circuit board 160, wireless charging interconnect 165, and wireless charging coil 166. FIG. 2G is also used to depict additional detail surround the spool 130 and lace 131 interface.

FIG. 2H is a top view of the lacing engine 10, according to example embodiments. FIG. 2H emphasizes the grease isolation wall 109 and illustrates how the grease isolation wall 109 surrounds certain portions of the drive mechanism, including spool 130, worm gear 150, worm drive 140, and gear box 145. In certain examples, the grease isolation wall 109 separates worm drive 140 from gear box 145. FIG. 2H also provides a top view of the interface between spool 130 and lace cable 131, with the lace cable 131 running in a medial-lateral direction through lace groove 132 in spool 130.

FIG. 2I is a top view illustration of the worm gear 150 and index wheel 151 portions of lacing engine 10, according to example embodiments. The index wheel 151 is a variation on the well-known Geneva wheel used in watchmaking and film projectors. A typical Geneva wheel or drive mechanism provides a method of translating continuous rotational movement into intermittent motion, such as is needed in a film projector or to make the second hand of a watch move intermittently. Watchmakers used a different type of Geneva wheel to prevent over-winding of a mechanical watch spring, but using a Geneva wheel with a missing slot (e.g., one of the Geneva slots 157 would be missing). The missing slot would prevent further indexing of the Geneva wheel, which was responsible for winding the spring and prevents over-winding. In the illustrated example, the lacing engine 10 includes a variation on the Geneva wheel, indexing wheel 151, which includes a small stop tooth 156 that acts as a stopping mechanism in a homing operation. As illustrated in FIGS. 2J-2M, the standard Geneva teeth 155 simply index for each rotation of the worm gear 150 when the index tooth 152 engages the Geneva slot 157 next to one of the Geneva teeth 155. However, when the index tooth 152 engages the Geneva slot 157 next to the stop tooth 156 a larger force is generated, which can be used to stall the drive mechanism in a homing operation. The stop tooth 156 can be used to create a known location of the mechanism for homing in case of loss of other positioning information, such as the motor encoder 146.

FIG. 2J-2M are illustrations of the worm gear 150 and index wheel 151 moving through an index operation, according to example embodiments. As discussed above, these figures illustrate what happens during a single full revolution of the worm gear 150 starting with FIG. 2J though FIG. 2M. In FIG. 2J, the index tooth 153 of the worm gear 150 is engaged in the Geneva slot 157 between a first Geneva tooth 155*a* of the Geneva teeth 155 and the stop tooth 156. FIG. 2K illustrates the index wheel 151 in a first index position, which is maintained as the index tooth 153 starts its revolution with the worm gear 150. In FIG. 2L, the index tooth 153 begins to engage the Geneva slot 157 on the opposite side of the first Geneva tooth 155*a*. Finally, in FIG. 2M the index tooth 153 is fully engaged within a Geneva lot 157 between the first Geneva tooth 155*a* and a second Geneva tooth 155*b*. The process shown in FIGS. 2J-2M continues with each revolution of the worm gear 150 until the index tooth 153 engages the stop tooth 156. As discussed above, wen the index tooth 153 engages the stop tooth 156, the increased forces can stall the drive mechanism.

FIG. 2N is an exploded view of lacing engine 10, according to example embodiments. The exploded view of the lacing engine 10 provides an illustration of how all the various components fit together. FIG. 2N shows the lacing engine 10 upside down, with the bottom section 104 at the top of the page and the top section 102 near the bottom. In this example, the wireless charging coil 166 is shown as being adhered to the outside (bottom) of the bottom section 104. The exploded view also provide a good illustration of how the worm drive 140 is assembled with the bushing 141, drive shaft 143, gear box 144 and gear motor 145. The illustration does not include a drive shaft pin that is received within the worm drive key 142 on a first end of the worm drive 140. As discussed above, the worm drive 140 slides over the drive shaft 143 to engage a drive shaft pin in the worm drive key 142, which is essentially a slot running transverse to the drive shaft 143 in a first end of the worm drive 140.

Figure 3A:
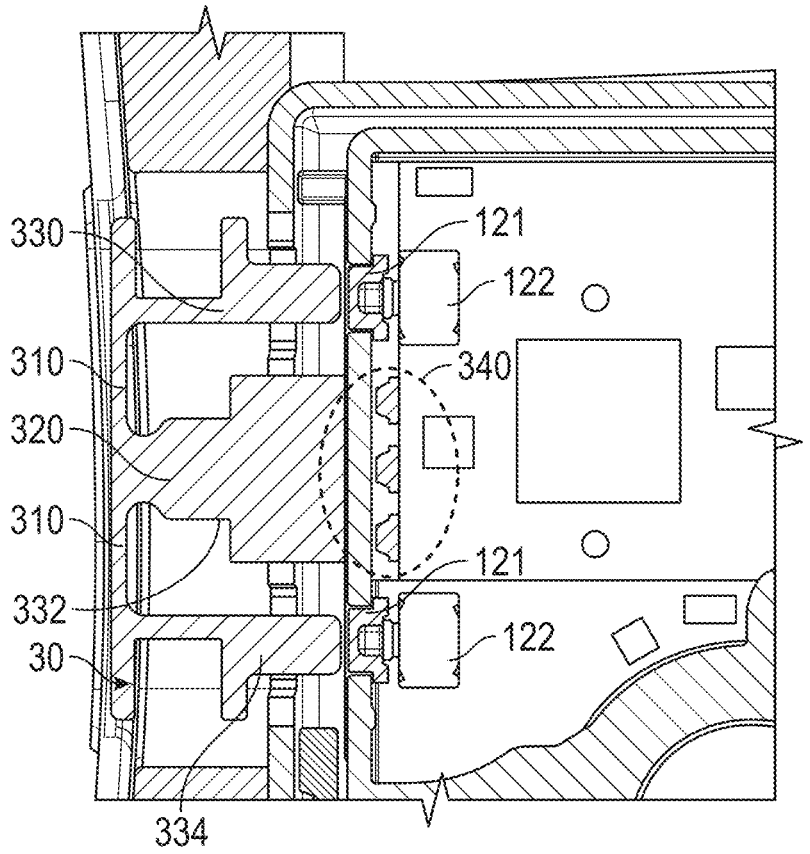
FIGS. 3A-3D are diagrams and drawings illustrating an actuator for interfacing with a motorized lacing engine, according to some example embodiments.

FIGS. 3A-3D are diagrams and drawings illustrating an actuator 30 for interfacing with a motorized lacing engine, according to an example embodiment. In this example, the actuator 30 includes features such as bridge 310, light pipe 320, posterior arm 330, central arm 332, and anterior arm 334. FIG. 3A also illustrates related features of lacing engine 10, such as LEDs 340 (also referenced as LED 340), buttons 121 and switches 122. In this example, the posterior arm 330 and anterior arm 334 each can separately activate one of the switches 122 through buttons 121. The actuator 30 is also designed to enable activation of both switches 122 simultaneously, for things like reset or other functions. The primary function of the actuator 30 is to provide tightening and loosening commands to the lacing engine 10. The actuator 30 also includes a light pipe 320 that directs light from LEDs 340 out to the external portion of the footwear platform (e.g., outsole 60). The light pipe 320 is structured to disperse light from multiple individual LED sources evening across the face of actuator 30.

In this example, the arms of the actuator 30, posterior arm 330 and anterior arm 334, include flanges to prevent over activation of switches 122 providing a measure of safety against impacts against the side of the footwear platform. The large central arm 332 is also designed to carry impact loads against the side of the lacing engine 10, instead of allowing transmission of these loads against the buttons 121.

Figure 3B:
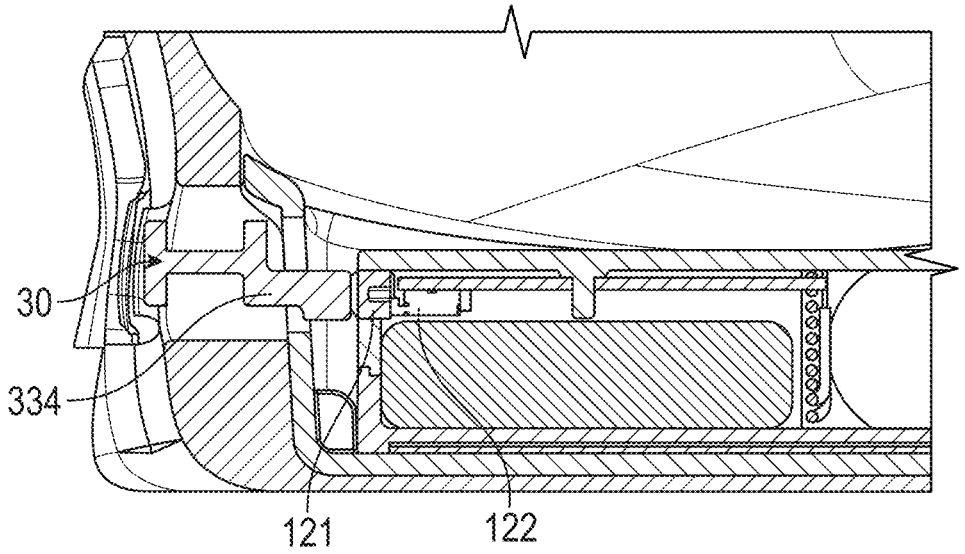
Figure 3C:
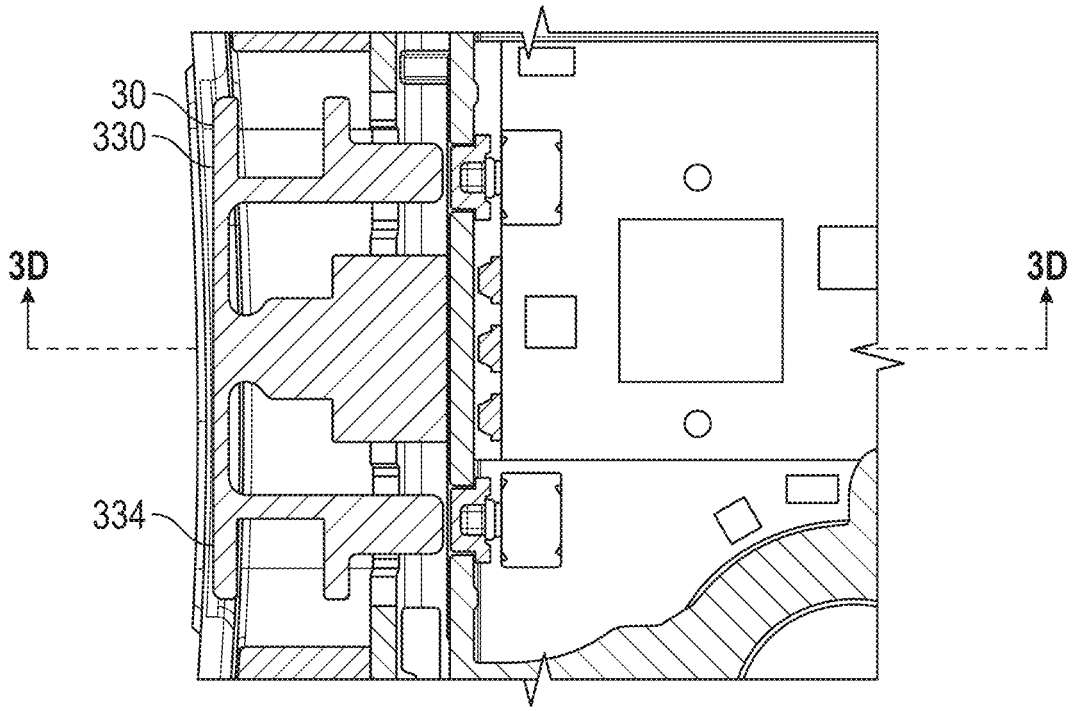
Figure 3D:
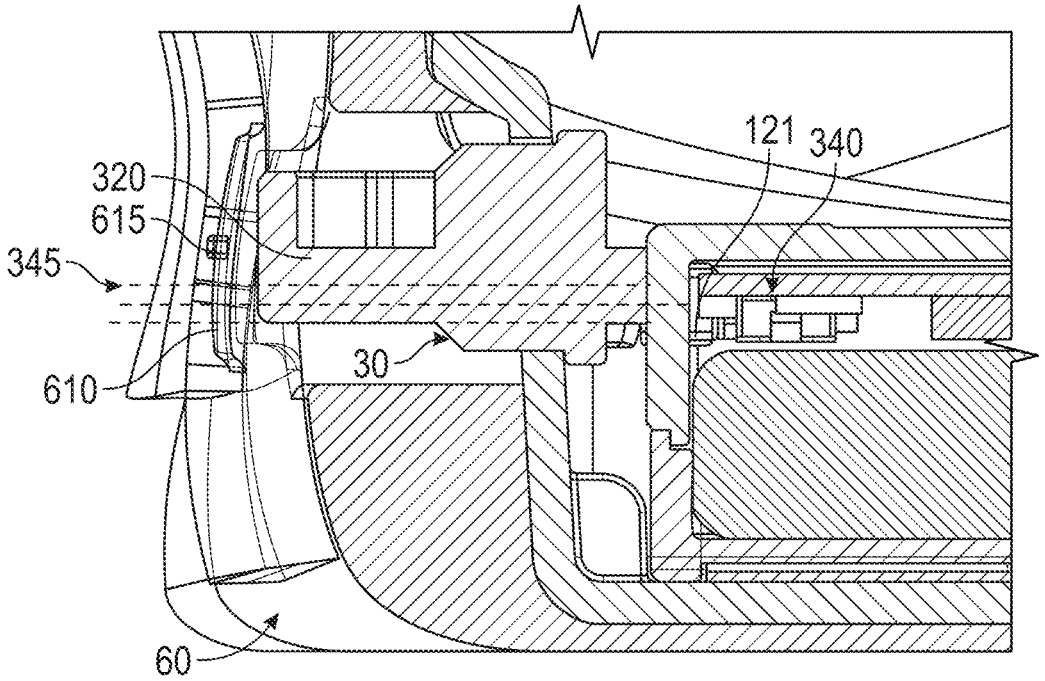

FIG. 3B provides a side view of the actuator 30, which further illustrates an example structure of anterior arm 334 and engagement with button 121. FIG. 3C is an additional top view of actuator 30 illustrating activation paths through posterior arm 330 and anterior arm 334. FIG. 3C also depicts section line A-A, which corresponds to the cross-section illustrated in FIG. 3D. In FIG. 3D, the actuator 30 is illustrated in cross-section with transmitted light 345 shown in dotted lines. The light pipe 320 provides a transmission medium for transmitted light 345 from LEDs 340. FIG. 3D also illustrates aspects of outsole 60, such as actuator cover 610 and raised actuator interface 615.

FIGS. 4A-4D are diagrams and drawings illustrating a mid-sole plate 40 for holding lacing engine 10, according to some example embodiments. In this example, the mid-sole plate 40 includes features such as lacing engine cavity 410, medial lace guide 420, lateral lace guide 421, lid slot 430, anterior flange 440, posterior flange 450, a superior surface 460, an inferior surface 470, and an actuator cutout 480. The lacing engine cavity 410 is designed to receive lacing engine 10. In this example, the lacing engine cavity 410 retains the lacing engine 10 is lateral and anterior/posterior directions, but does not include any built in feature to lock the lacing engine 10 in to the pocket. Optionally, the lacing engine cavity 410 can include detents, tabs, or similar mechanical features along one or more sidewalls that could positively retain the lacing engine 10 within the lacing engine cavity 410.

The medial lace guide 420 and lateral lace guide 421 assist in guiding lace cable into the lace engine pocket 410 and over lacing engine 10 (when present). The medial/lateral lace guides 420, 421 can include chamfered edges and inferiorly slated ramps to assist in guiding the lace cable into the desired position over the lacing engine 10. In this example, the medial/lateral lace guides 420, 421 include openings in the sides of the mid-sole plate 40 that are many times wider than the typical lacing cable diameter, in other examples the openings for the medial/lateral lace guides 420, 421 may only be a couple times wider than the lacing cable diameter.

In this example, the mid-sole plate 40 includes a sculpted or contoured anterior flange 440 that extends much further on the medial side of the mid-sole plate 40. The example anterior flange 440 is designed to provide additional support under the arch of the footwear platform. However, in other examples the anterior flange 440 may be less pronounced in on the medial side. In this example, the posterior flange 450 also includes a particular contour with extended portions on both the medial and lateral sides. The illustrated posterior flange 450 shape provides enhanced lateral stability for the lacing engine 10.

Figure 4A:
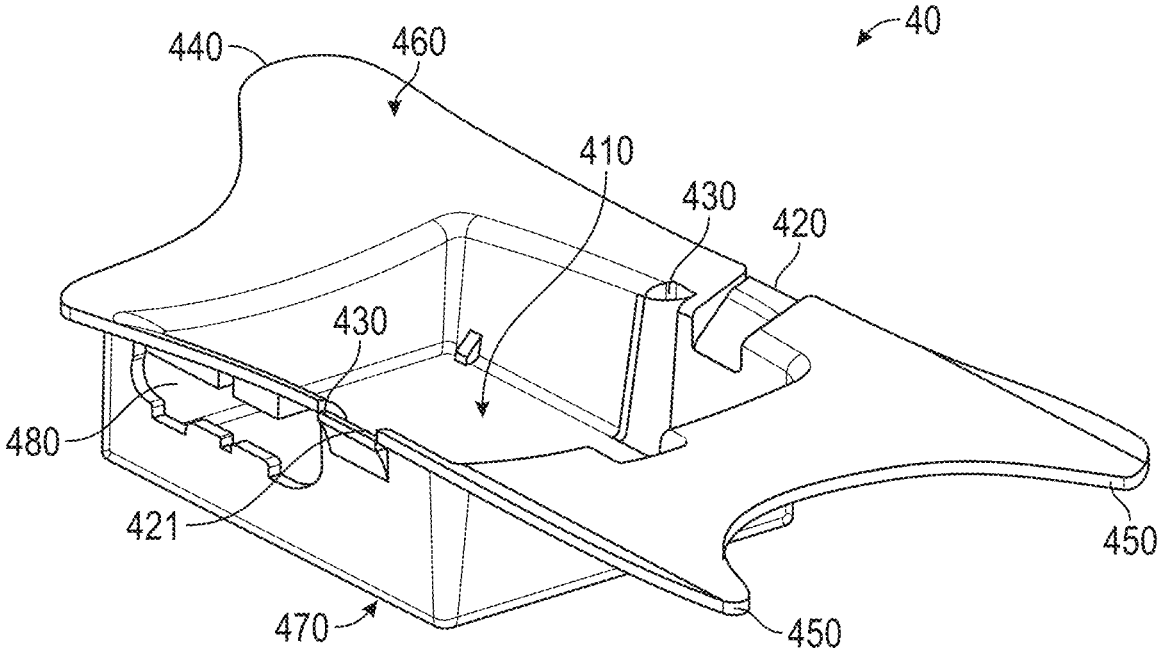
FIGS. 4A-4D are diagrams and drawings illustrating a mid-sole plate for holding a lacing engine, according to some example embodiments.
Figure 4B:
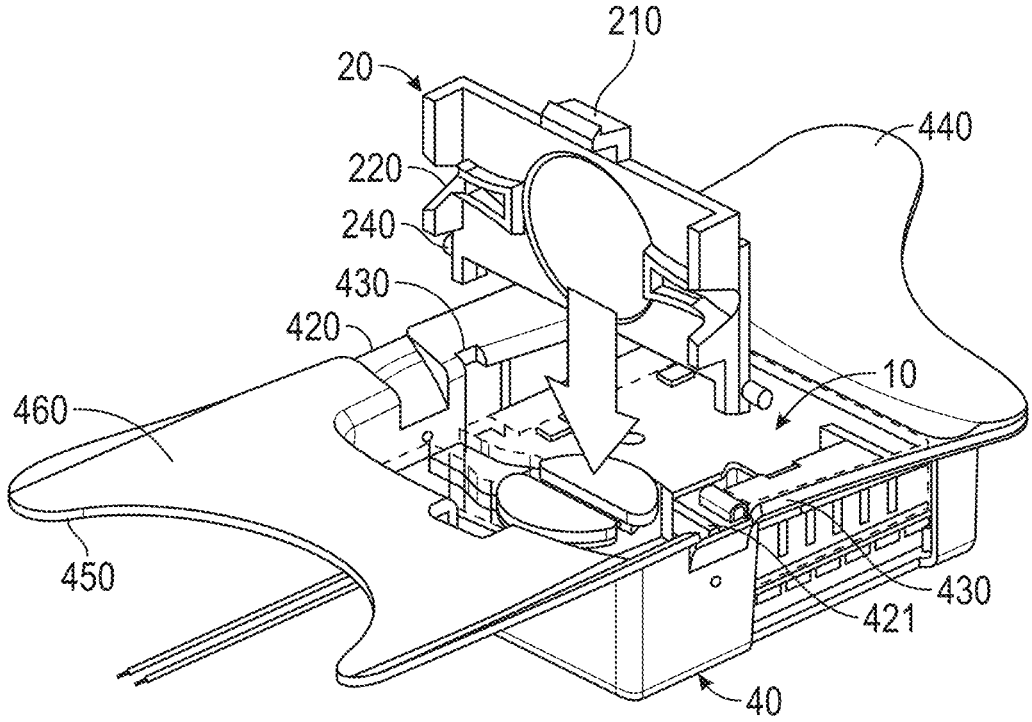
Figure 4C:
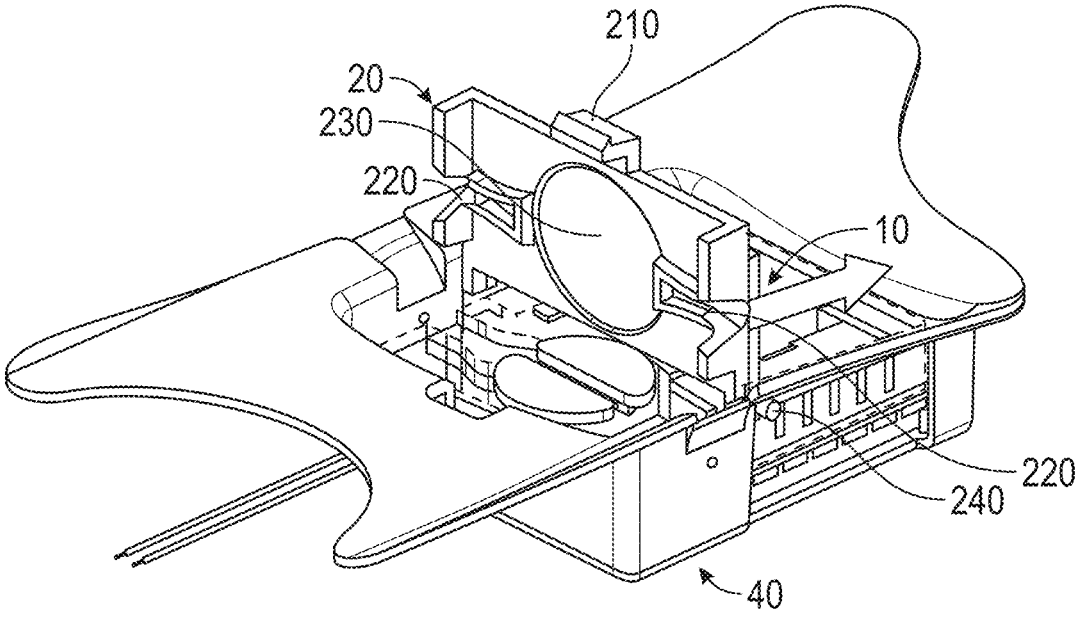
Figure 4D:
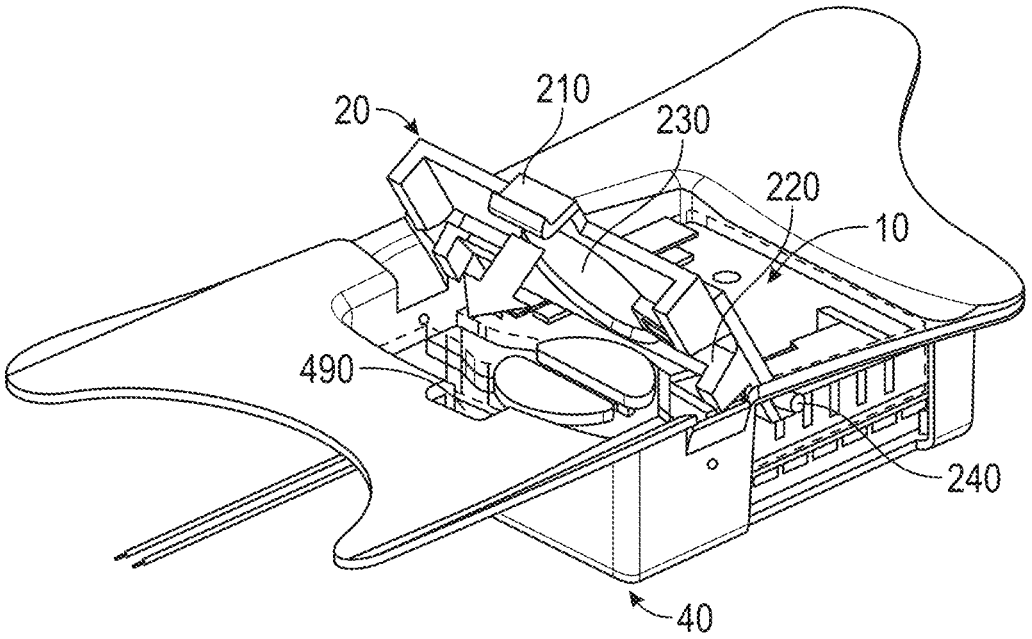

FIGS. 4B-4D illustrate insertion of the lid 20 into the mid-sole plate 40 to retain the lacing engine 10 and capture lace cable 131. In this example, the lid 20 includes features such as latch 210, lid lace guides 220, lid spool recess 230, and lid clips 240. The lid lace guides 220 can include both medial and lateral lid lace guides 220. The lid lace guides 220 assist in maintaining alignment of the lace cable 131 through the proper portion of the lacing engine 10. The lid clips 240 can also include both medial and lateral lid clips 240. The lid clips 240 provide a pivot point for attachment of the lid 20 to the mid-sole plate 40. As illustrated in FIG. 4B, the lid 20 is inserted straight down into the mid-sole plate 40 with the lid clips 240 entering the mid-sole plate 40 via the lid slots 430.

As illustrated in FIG. 4C, once the lid clips 240 are inserted through the lid slots 430, the lid 20 is shifted anteriorly to keep the lid clips 240 from disengaging from the mid-sole plate 40. FIG. 4D illustrates rotation or pivoting of the lid 20 about the lid clips 240 to secure the lacing engine 10 and lace cable 131 by engagement of the latch 210 with a lid latch recess 490 in the mid-sole plate 40. Once snapped into position, the lid 20 secures the lacing engine 10 within the mid-sole plate 40.

Figure 5A:
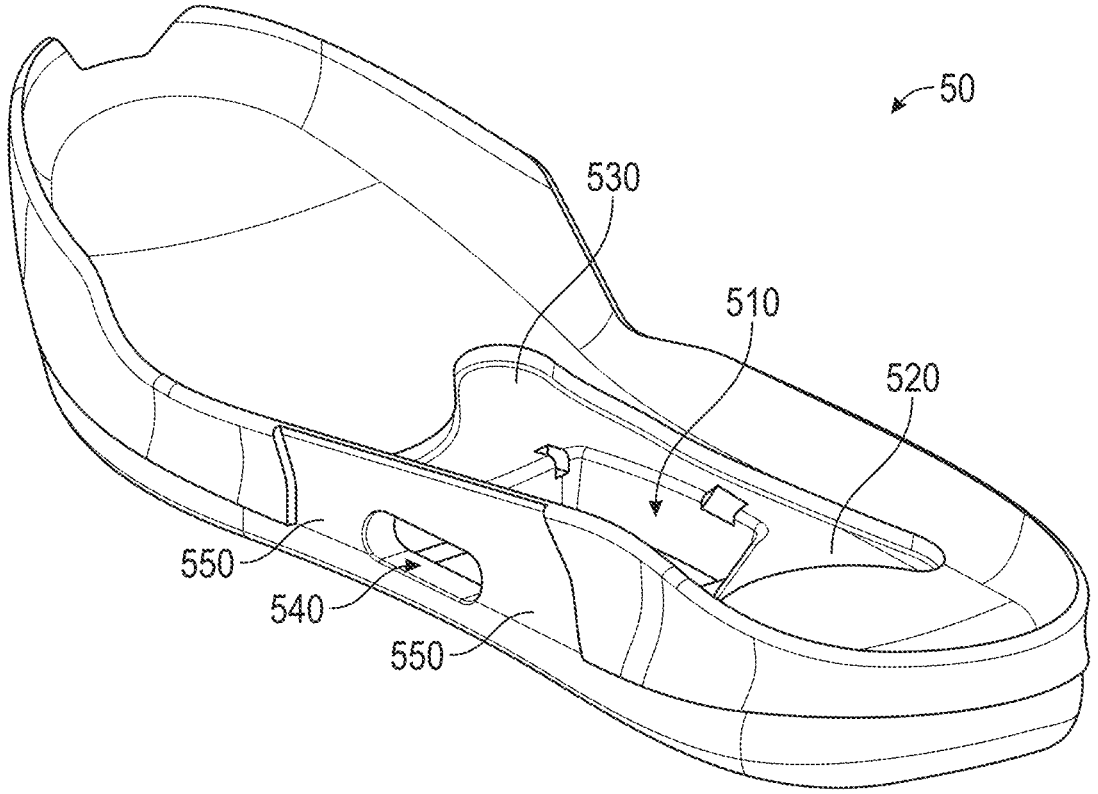
FIGS. 5A-5D are diagrams and drawings illustrating a mid-sole and out-sole to accommodate a lacing engine and related components, according to some example embodiments.
Figure 5B:
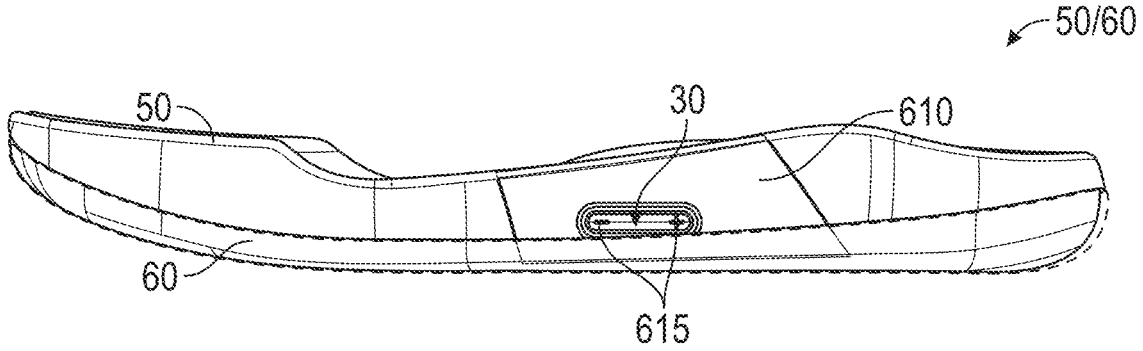
Figure 5C:
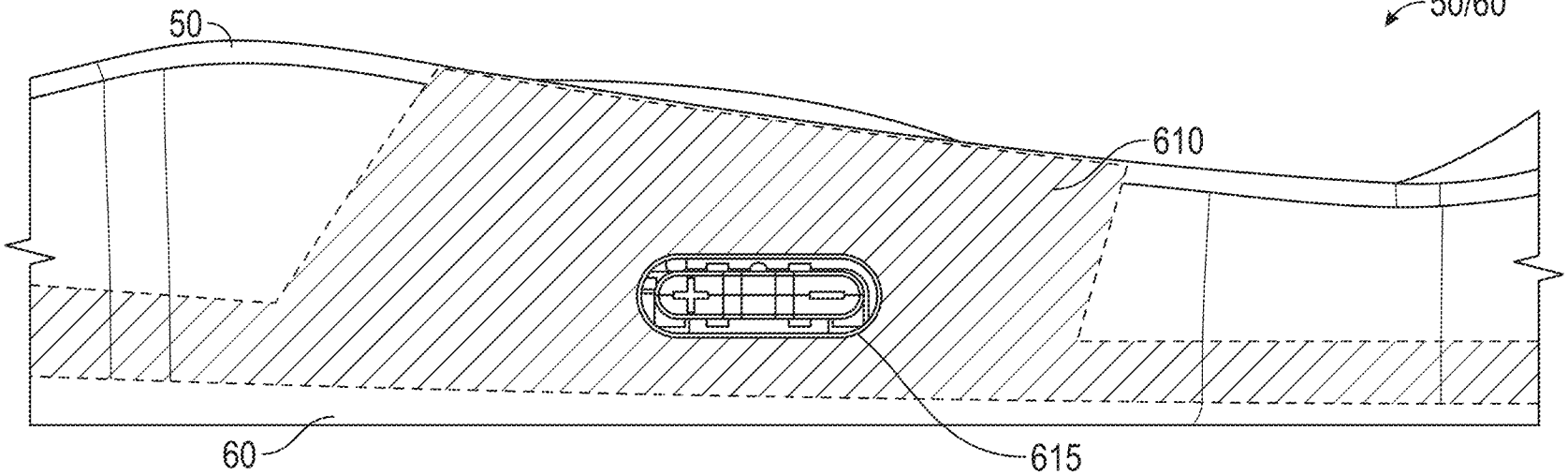

FIGS. 5A-5D are diagrams and drawings illustrating a mid-sole 50 and out-sole 60 configured to accommodate lacing engine 10 and related components, according to some example embodiments. The mid-sole 50 can be formed from any suitable footwear material and includes various features to accommodate the mid-sole plate 40 and related components. In this example, the mid-sole 50 includes features such as plate recess 510, anterior flange recess 520, posterior flange recess 530, actuator opening 540 and actuator cover recess 550. The plate recess 510 includes various cutouts and similar features to match corresponding features of the mid-sole plate 40. The actuator opening 540 is sized and positioned to provide access to the actuator 30 from the lateral side of the footwear platform 1. The actuator cover recess 550 is a recessed portion of the mid-sole 50 adapted to accommodate a molded covering to protect the actuator 30 and provide a particular tactile and visual look for the primary user interface to the lacing engine 10, as illustrated in FIGS. 5B and 5C.

FIGS. 5B and 5C illustrate portions of the mid-sole 50 and out-sole 60, according to example embodiments. FIG. 5B includes illustration of exemplary actuator cover 610 and raised actuator interface 615, which is molded or otherwise formed into the actuator cover 610. FIG. 5C illustrates an additional example of actuator 610 and raised actuator interface 615 including horizontal striping to disperse portions of the light transmitted to the out-sole 60 through the light pipe 320 portion of actuator 30.

Figure 5D:
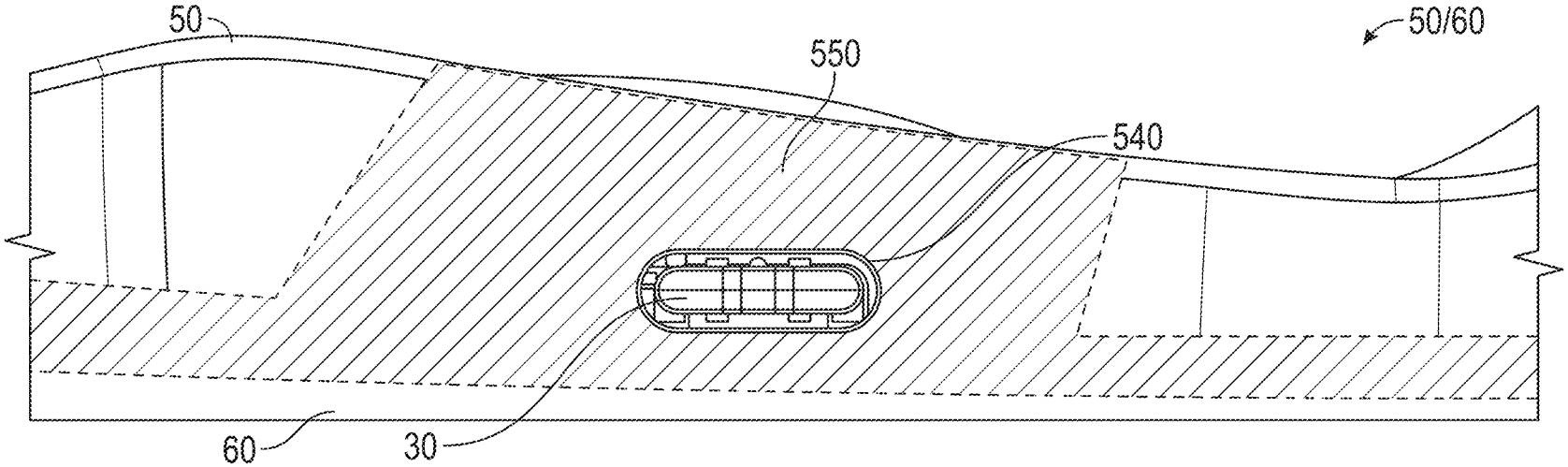

FIG. 5D further illustrates actuator cover recess 550 on mid-sole 50 as well as positioning of actuator 30 within actuator opening 540 prior to application of actuator cover 610. In this example, the actuator cover recess 550 is designed to receive adhesive to adhere actuator cover 610 to the mid-sole 50 and out-sole 60.

Figure 6A:
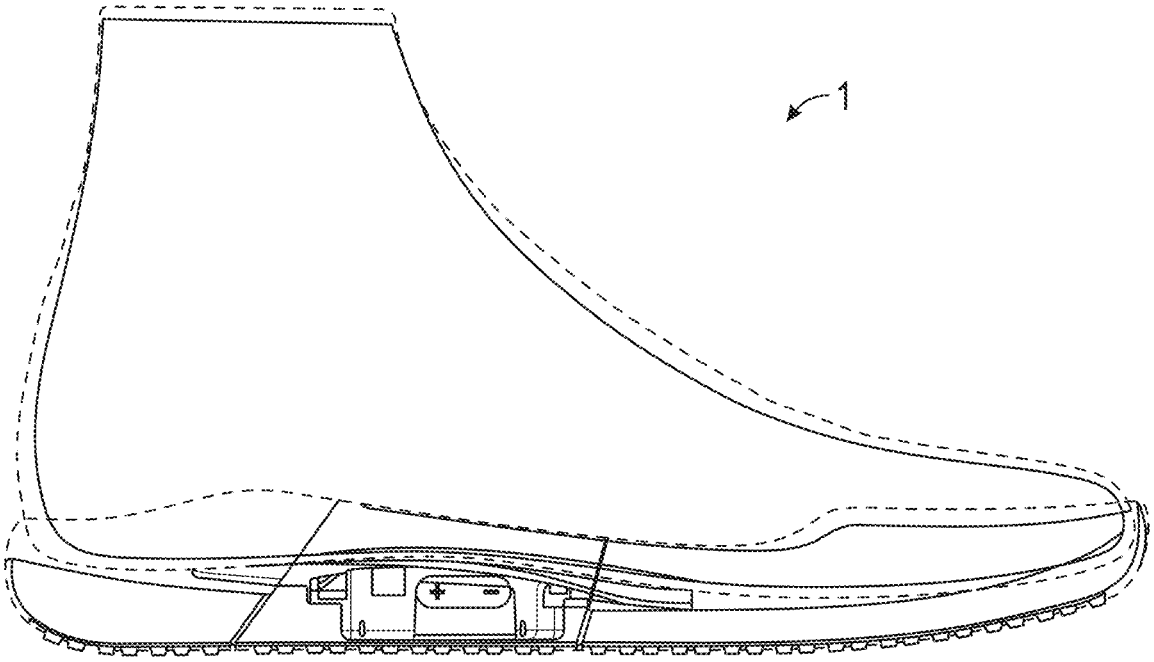
FIGS. 6A-6D are illustrations of a footwear assembly including a motorized lacing engine, according to some example embodiments.
Figure 6B:
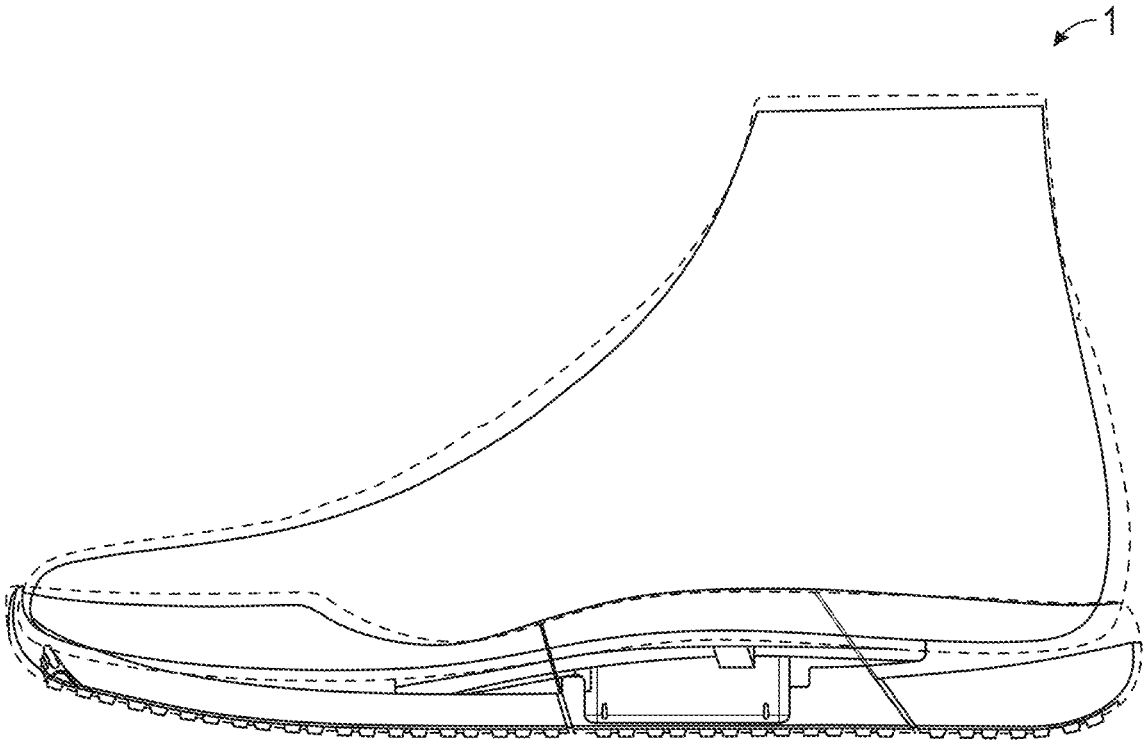
Figure 6C:
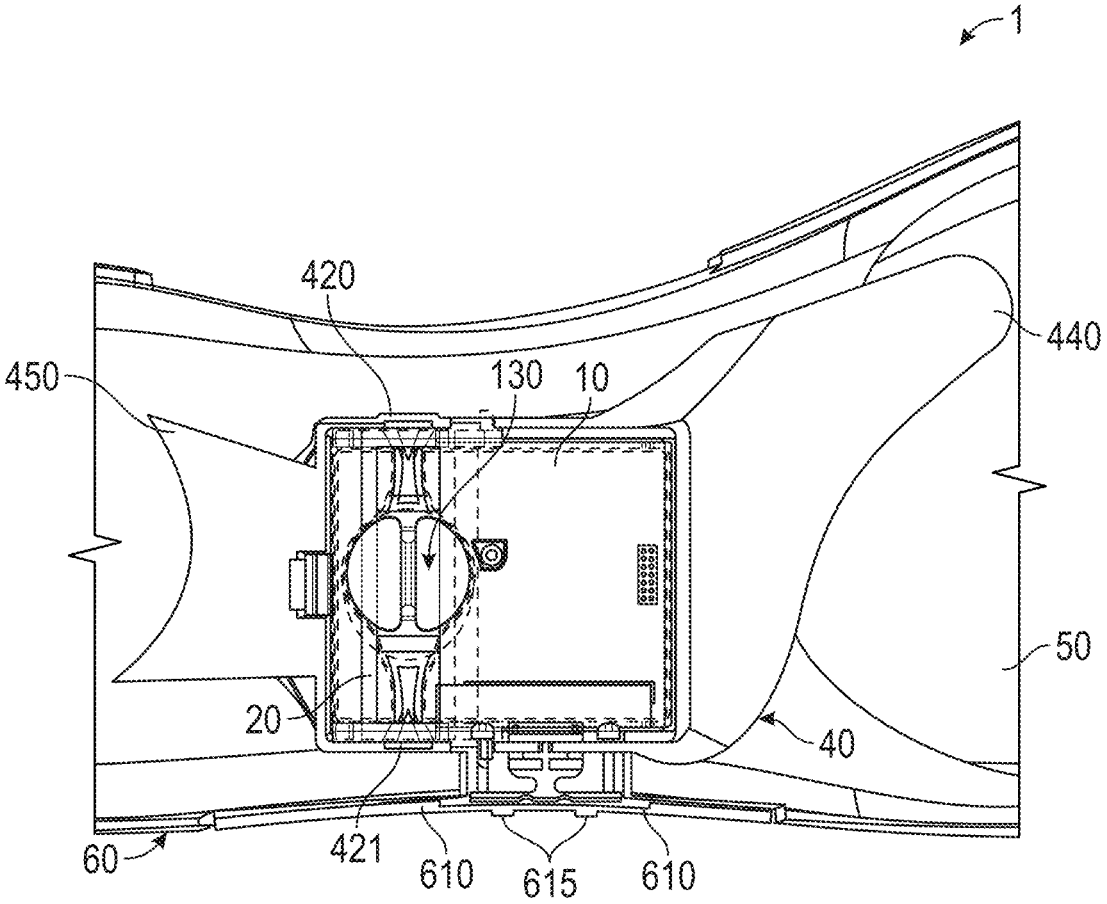

FIGS. 6A-6D are illustrations of a footwear assembly 1 including a motorized lacing engine 10, according to some example embodiments. In this example, FIGS. 6A-6C depict transparent examples of an assembled automated footwear platform 1 including a lacing engine 10, a mid-sole plate 40, a mid-sole 50, and an out-sole 60. FIG. 6A is a lateral side view of the automated footwear platform 1. FIG. 6B is a medial side view of the automated footwear platform 1. FIG. 6C is a top view, with the upper portion removed, of the automated footwear platform 1. The top view demonstrates relative positioning of the lacing engine 10, the lid 20, the actuator 30, the mid-sole plate 40, the mid-sole 50, and the out-sole 60. In this example, the top view also illustrates the spool 130, the medial lace guide 420 the lateral lace guide 421, the anterior flange 440, the posterior flange 450, the actuator cover 610, and the raised actuator interface 615.

Figure 6D:
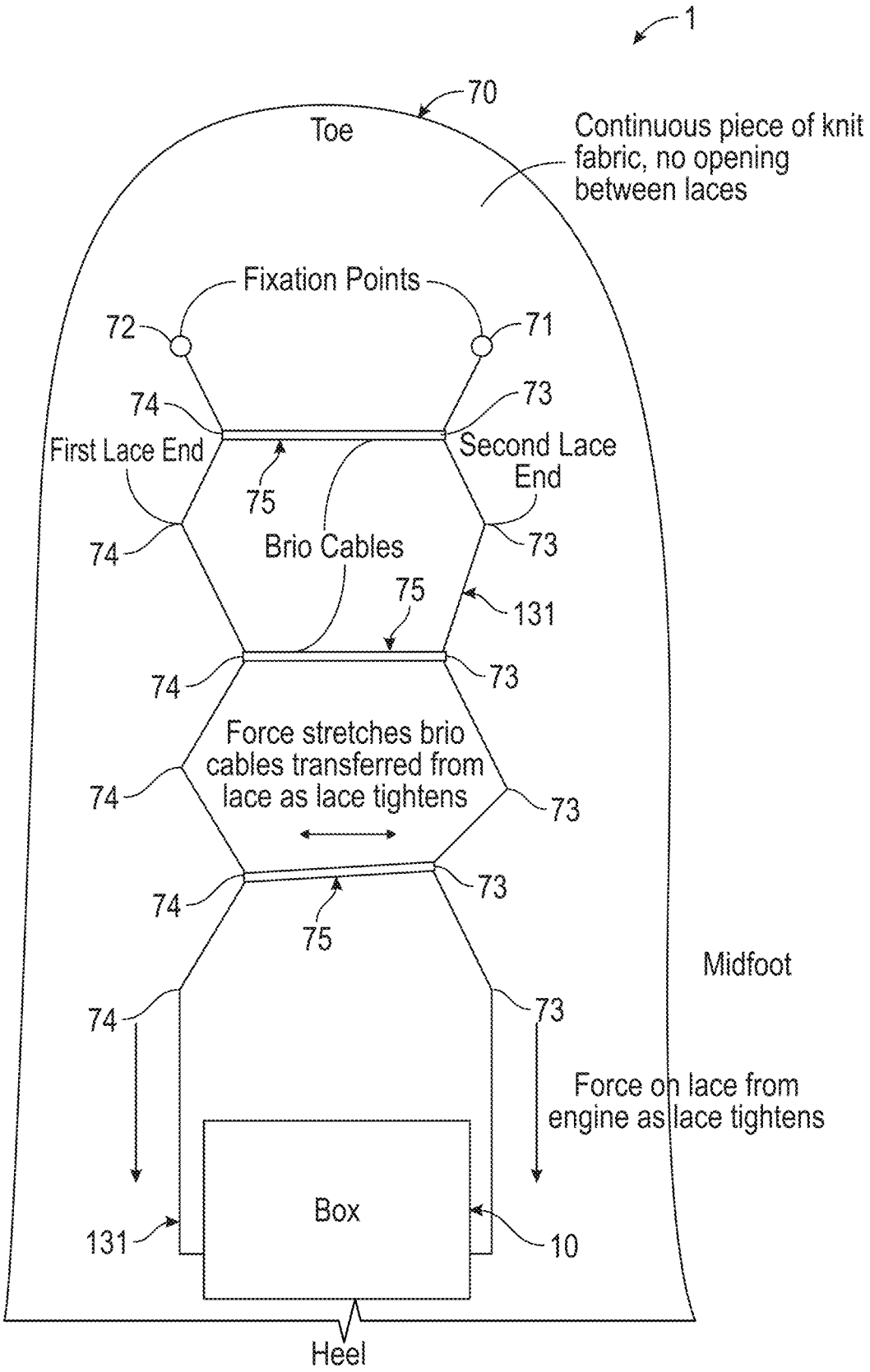

FIG. 6D is a top view diagram of upper 70 illustrating an example lacing configuration, according to some example embodiments. In this example, the upper 70 includes lateral lace fixation 71, medial lace fixation 72, lateral lace guides 73, medial lace guides 74, and brio cables 75, in additional to lace 131 and lacing engine 10. The example illustrated in FIG. 6D includes a continuous knit fabric upper 70 with diagonal lacing pattern involving non-overlapping medial and lateral lacing paths. The lacing paths are created starting at the lateral lace fixation running through the lateral lace guides 73 through the lacing engine 10 up through the medial lace guides 74 back to the medial lace fixation 72. In this example, lace 131 forms a continuous loop from lateral lace fixation 71 to medial lace fixation 72. Medial to lateral tightening is transmitted through brio cables 75 in this example. In other examples, the lacing path may crisscross or incorporate additional features to transmit tightening forces in a medial-lateral direction across the upper 70. Additionally, the continuous lace loop concept can be incorporated into a more traditional upper with a central (medial) gap and lace 131 crisscrossing back and forth across the central gap.

Assembly Processes

Figure 7:
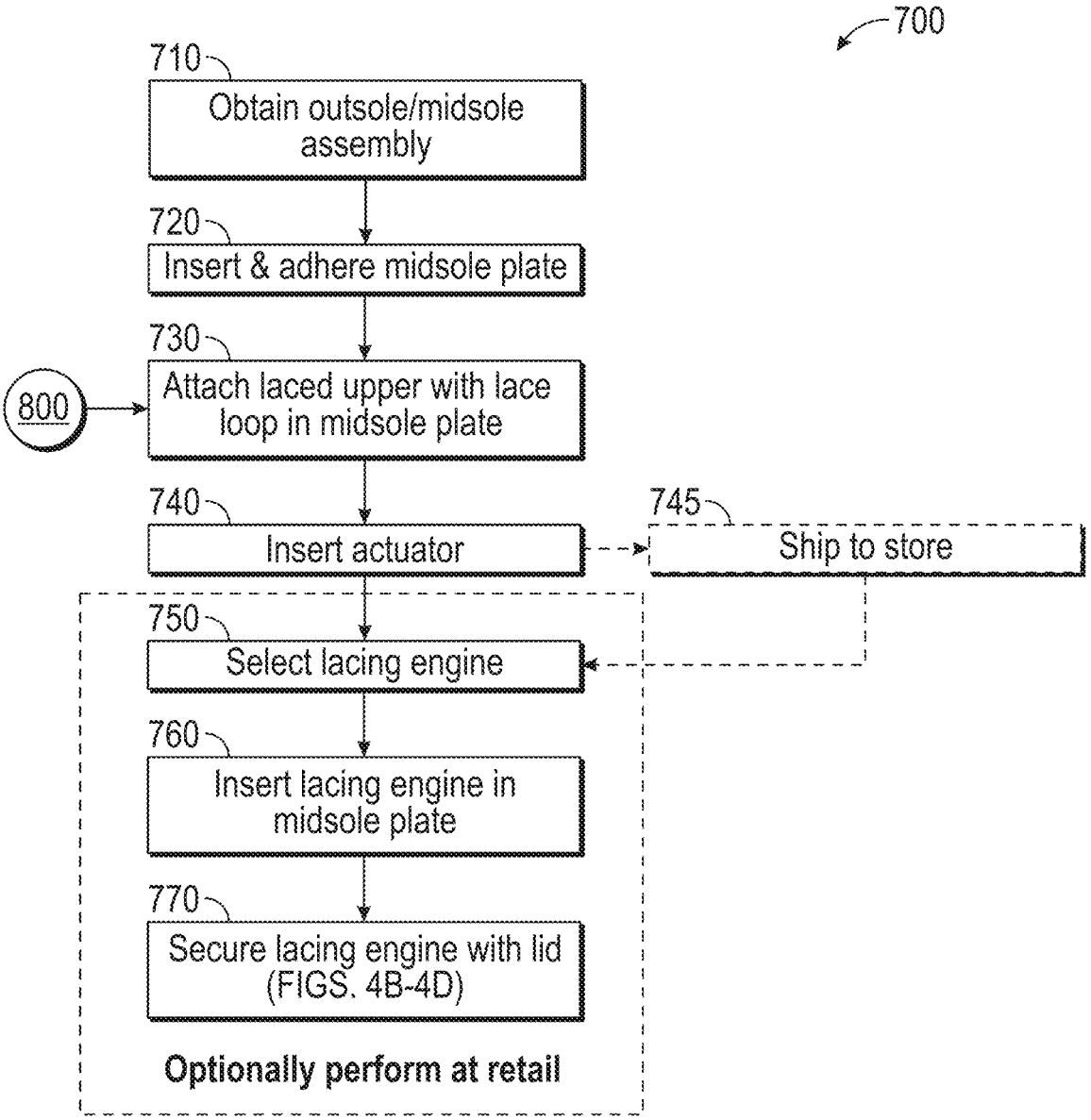
FIG. 7 is a flowchart illustrating a footwear assembly process for assembly of footwear including a lacing engine, according to some example embodiments.

FIG. 7 is a flowchart illustrating a footwear assembly process for assembly of an automated footwear platform 1 including lacing engine 10, according to some example embodiments. In this example, the assembly process includes operations such as: obtaining an outsole/midsole assembly at 710, inserting and adhering a mid-sole plate at 720, attaching laced upper at 730, inserting actuator at 740, optionally shipping the subassembly to a retail store at 745, selecting a lacing engine at 750, inserting a lacing engine into the mid-sole plate at 760, and securing the lacing engine at 770. The process 700 described in further detail below can include some or all of the process operations described and at least some of the process operations can occur at various locations (e.g., manufacturing plant versus retail store). In certain examples, all of the process operations discussed in reference to process 700 can be completed within a manufacturing location with a completed automated footwear platform delivered directly to a consumer or to a retail location for purchase. The process 700 can also include assembly opertions associated with assembly of the lacing engine 10, which are illustrated and discussed above in reference to various figures, including FIGS. 1-4D. Many of these details are not specifically discussed in reference to the description of process 700 provided below solely for the sake of brevity and clarity.

In this example, the process 700 begins at 710 with obtaining an out-sole and mid-sole assembly, such as mid-sole 50 and out-sole 60. The mid-sole 50 can be adhered to out-sole 60 during or prior to process 700. At 720, the process 700 continues with insertion of a mid-sole plate, such as mid-sole plate 40, into a plate recess 510. In some examples, the mid-sole plate 40 includes a layer of adhesive on the inferior surface to adhere the mid-sole plate into the mid-sole. In other examples, adhesive is applied to the mid-sole prior to insertion of a mid-sole plate. In some examples, the adhesive can be heat activated after assembly of the mid-sole plate 40 into the plate recess 510. In still other examples, the mid-sole is designed with an interference fit with the mid-sole plate, which does not require adhesive to secure the two components of the automated footwear platform. In yet other examples, the mid-sole plate is secured through a combination of interference fit and fasteners, such as adhesive.

At 730, the process 700 continues with a laced upper portion of the automated footwear platform being attached to the mid-sole. Attachment of the laced upper portion is done through any known footwear manufacturing process, with the addition of positioning a lower lace loop into the mid-sole plate for subsequent engagement with a lacing engine, such as lacing engine 10. For example, attaching a laced upper to mid-sole 50 with mid-sole plate 40 inserted, a lower lace loop is positioned to align with medial lace guide 420 and lateral lace guide 421, which position the lace loop properly to engage with lacing engine 10 when inserted later in the assembly process. Assembly of the upper portion is discussed in greater detail in reference to FIGS. 8A1-8A6 and 8B below, including how the lace loop can be formed during assembly.

At 740, the process 700 continues with insertion of an actuator, such as actuator 30, into the mid-sole plate. Optionally, insertion of the actuator can be done prior to attachment of the upper portion at operation 730. In an example, insertion of actuator 30 into the actuator cutout 480 of mid-sole plate 40 involves a snap fit between actuator 30 and actuator cutout 480. Optionally, process 700 continues at 745 with shipment of the subassembly of the automated footwear platform to a retail location or similar point of sale. The remaining operations within process 700 can be performed without special tools or materials, which allows for flexible customization of the product sold at the retail level without the need to manufacture and inventory every combination of automated footwear subassembly and lacing engine options. Even if there are only two different lacing engine options, fully automated and manually activated for example, the ability to configure the footwear platform at a retail level enhances flexibility and allows for ease of servicing lacing engines.

At 750, the process 700 continues with selection of a lacing engine, which may be an optional operation in cases where only one lacing engine is available. In an example, lacing engine 10, a motorized lacing engine, is chosen for assembly into the subassembly from operations 710-740. However, as noted above, the automated footwear platform is designed to accommodate various types of lacing engines from fully automatic motorized lacing engines to human-power manually activated lacing engines. The subassembly built up in operations 710-740, with components such as out-sole 60, mid-sole 50, and mid-sole plate 40, provides a modular platform to accommodate a wide range of optional automation components.

At 760, the process 700 continues with insertion of the selected lacing engine into the mid-sole plate. For example, lacing engine 10 can be inserted into mid-sole plate 40, with the lacing engine 10 slipped underneath the lace loop running through the lacing engine cavity 410. With the lacing engine 10 in place and the lace cable engaged within the spool of the lacing engine, such as spool 130, a lid (or similar component) can be installed into the mid-sole plate to secure the lacing engine 10 and lace. An example of installation of lid 20 into mid-sole plate 40 to secure lacing engine 10 is illustrated in FIGS. 4B-4D and discussed above. With the lid secured over the lacing engine, the automated footwear platform is complete and ready for active use.

FIGS. 8A1-8A6 and 8B include a set of illustrations and a flowchart depicting generally an assembly process 800 for assembly of a footwear upper in preparation for assembly to a mid-sole, according to some example embodiments.

Figure 8B:
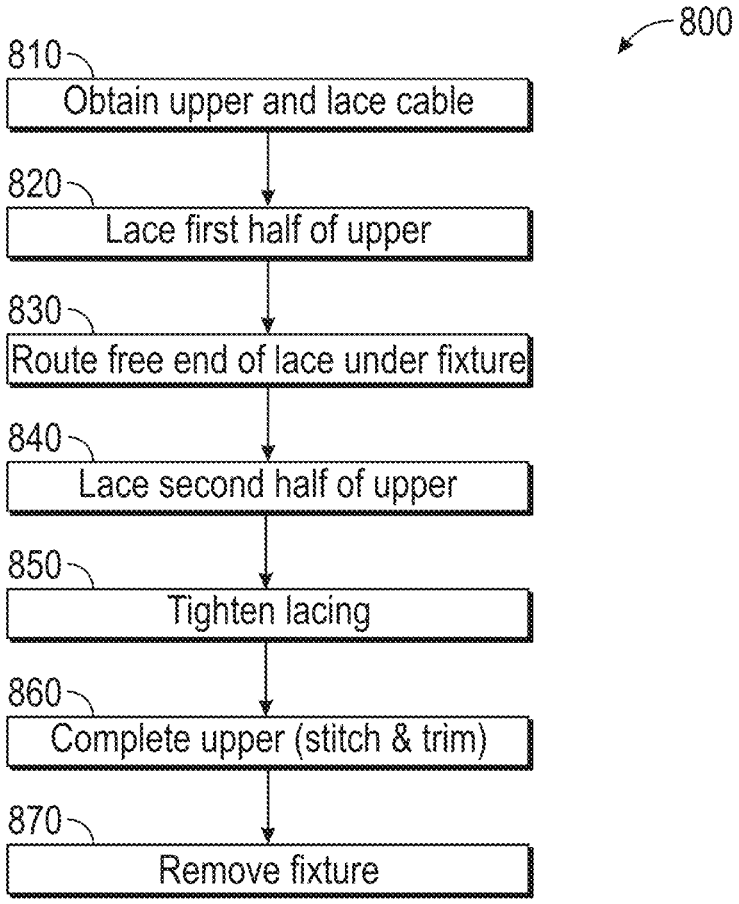

FIGS. 8A1-8A6 visually depict a series of assembly operations to assemble a laced upper portion of a footwear assembly for eventual assembly into an automated footwear platform, such as though process 700 discussed above. Process 800 illustrated in FIGS. 8A1-8A6 includes operations discussed further below in reference to FIG. 8B. In this example, process 800 starts with operation 810, which involves obtaining a knit upper and a lace (lace cable). Next, at operation 820, a first half of the knit upper is laced with the lace. In this example, lacing the upper involves threading the lace cable through a number of eyelets and securing one end to an anterior section of the upper. Next, at operation 830, the lace cable is routed under a fixture supporting the upper and around to the opposite side. In some examples, the fixture includes a specific routing grove or feature to create the desired lace loop length. Then, at operation 840, the other half of the upper is laced, while maintaining a lower loop of lace around the fixture. The illustrated version of operation 840 can also include tightening the lace, which is operation 850 in FIG. 8B. At 860, the lace is secured and trimmed and at 870 the fixture is removed to leave a laced knit upper with a lower lace loop under the upper portion.

FIG. 8B is a flowchart illustrating another example of process 800 for assembly of a footwear upper. In this example, the process 800 includes operations such as obtaining an upper and lace cable at 810, lacing the first half of the upper at 820, routing the lace under a lacing fixture at 830, lacing the second half of the upper at 840, tightening the lacing at 850, completing upper at 860, and removing the lacing fixture at 870.

The process 800 begins at 810 by obtaining an upper and a lace cable to being assembly. Obtaining the upper can include placing the upper on a lacing fixture used through other operations of process 800. As noted above, one function of the lacing fixture can be to provide a mechanism for generating repeatable lace loops for a particular footwear upper. In certain examples, the fixtures may be shoe size dependent, while in other examples the fixtures may accommodate multiple sizes and/or upper types. At 820, the process 800 continues by lacing a first half of the upper with the lace cable. Lacing operation can include routing the lace cable through a series of eyelets or similar features built into the upper. The lacing operation at 820 can also include securing one end (e.g., a first end) of the lace cable to a portion of the upper. Securing the lace cable can include sewing, tying off, or otherwise terminating a first end of the lace cable to a fixed portion of the upper.

At 830, the process 800 continues with routing the free end of the lace cable under the upper and around the lacing fixture. In this example, the lacing fixture is used to create a proper lace loop under the upper for eventual engagement with a lacing engine after the upper is joined with a mid-sole/out-sole assembly (see discussion of FIG. 7 above). The lacing fixture can include a groove or similar feature to at least partially retain the lace cable during the sequent operations of process 800.

At 840, the process 800 continues with lacing the second half of the upper with the free end of the lace cable. Lacing the second half can include routing the lace cable through a second series of eyelets or similar features on the second half of the upper. At 850, the process 800 continues by tightening the lace cable through the various eyelets and around the lacing fixture to ensure that the lower lace loop is properly formed for proper engagement with a lacing engine. The lacing fixture assists in obtaining a proper lace loop length, and different lacing fixtures can be used for different size or styles of footwear. The lacing process is completed at 860 with the free end of the lace cable being secured to the second half of the upper. Completion of the upper can also include additional trimming or stitching operations. Finally, at 870, the process 800 completes with removal of the upper from the lacing fixture.

Figures 9A, 9B, 9C:
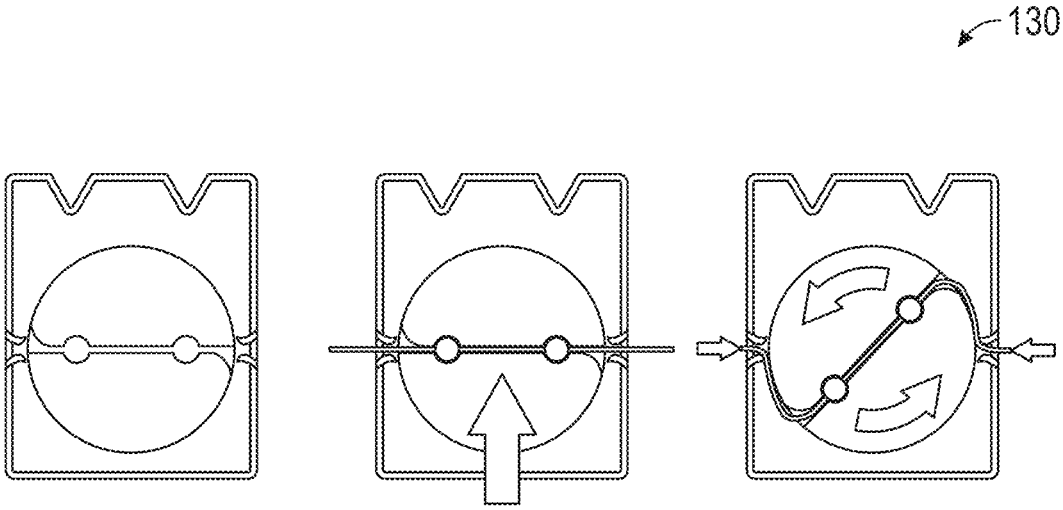
FIGS. 9A-9C is a are drawings illustrating a mechanism for securing a lace within a spool of a lacing engine, according to some example embodiments.

FIGS. 9A-9C are drawings illustrating a mechanism for securing a lace within a spool of a lacing engine, according to some example embodiments. In this example, spool 130 of lacing engine 10 receives lace cable 131 within lace grove 132.

FIGS. 9A-9C include a lace cable with ferrules and a spool with a lace groove that include recesses to receive the ferrules. In this example, the ferrules snap (e.g., interference fit) into recesses to assist in retaining the lace cable within the spool. Other example spools, such as spool 130, do not include recesses and other components of the automated footwear platform are used to retain the lace cable in the lace groove of the spool.

Figure 10A:
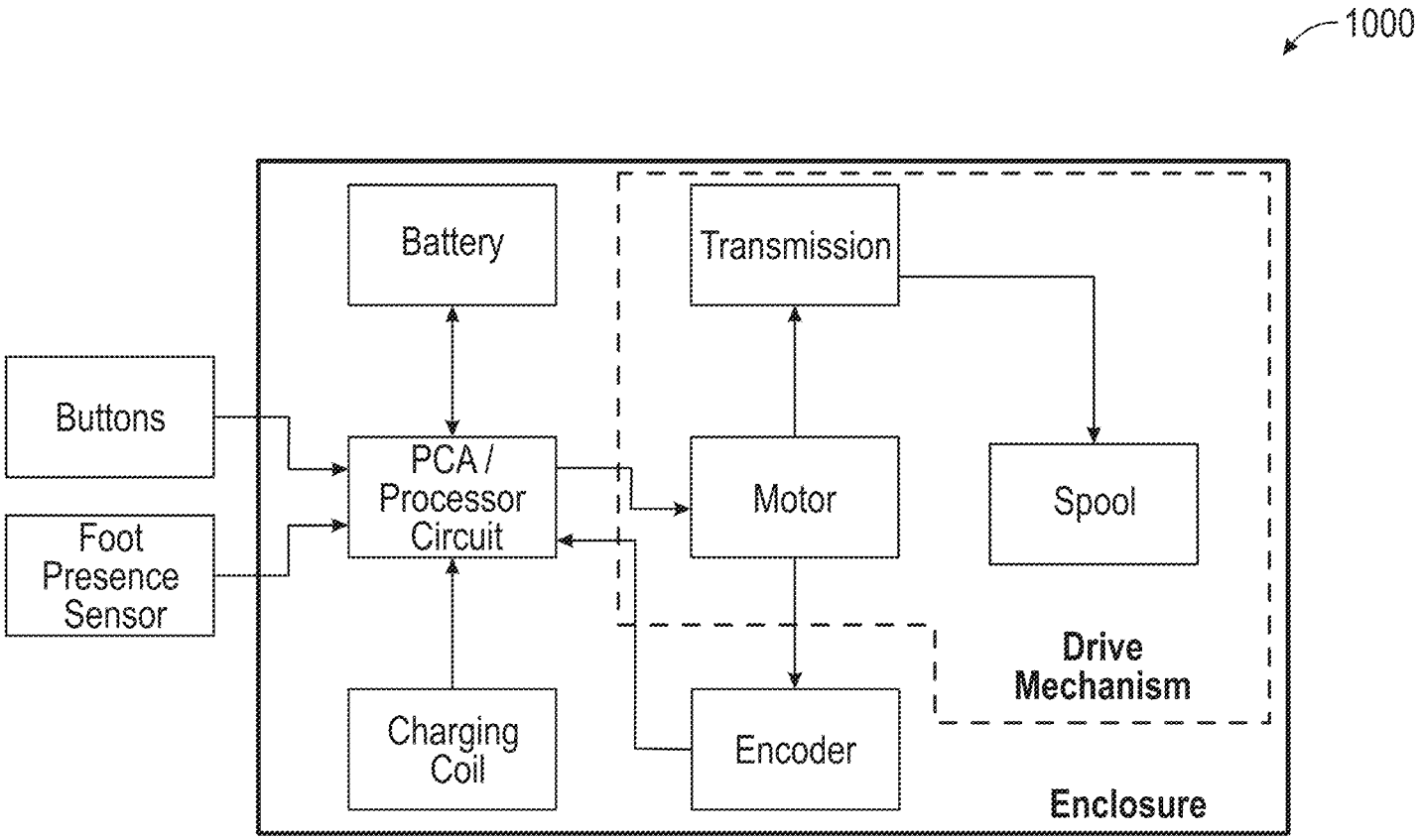
FIG. 10A is a block diagram illustrating components of a motorized lacing system, according to some example embodiments.

FIG. 10A is a block diagram illustrating components of a motorized lacing system for footwear, according to some example embodiments. The system 1000 illustrates basic components of a motorized lacing system such as including interface buttons, foot presence sensor(s), a printed circuit board assembly (PCA) with a processor circuit, a battery, a charging coil, an encoder, a motor, a transmission, and a spool. In this example, the interface buttons and foot presence sensor(s) communicate with the circuit board (PCA), which also communicates with the battery and charging coil. The encoder and motor are also connected to the circuit board and each other. The transmission couples the motor to the spool to form the drive mechanism.

In an example, the processor circuit controls one or more aspects of the drive mechanism. For example, the processor circuit can be configured to receive information from the buttons and/or from the foot presence sensor and/or from the battery and/or from the drive mechanism and/or from the encoder, and can be further configured to issue commands to the drive mechanism, such as to tighten or loosen the footwear, or to obtain or record sensor information, among other functions.

Motor Control Scheme

Figure 11C:
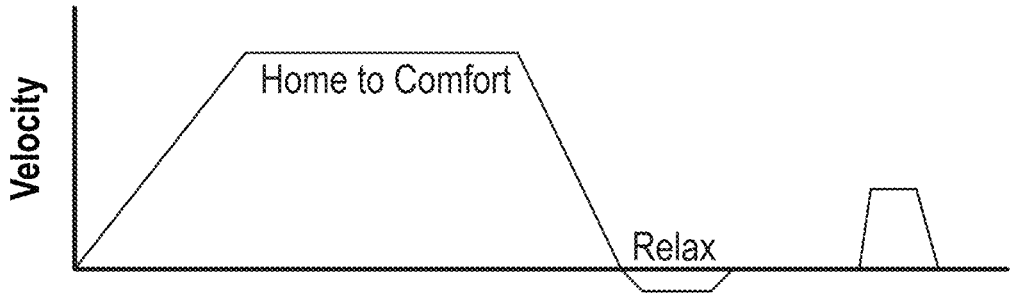

FIG. 11A-11D are diagrams illustrating a motor control scheme 1100 for a motorized lacing engine, according to some example embodiments. In this example, the motor control scheme 1100 involves dividing up the total travel, in terms of lace take-up, into segments, with the segments varying in size based on position on a continuum of lace travel (e.g., between home/loose position on one end and max tightness on the other). As the motor is controlling a radial spool and will be controlled, primarily, via a radial encoder on the motor shaft, the segments can be sized in terms of degrees of spool travel (which can also be viewed in terms of encoder counts). On the loose side of the continuum, the segments can be larger, such as 10 degrees of spool travel, as the amount of lace movement is less critical. However, as the laces are tightened each increment of lace travel becomes more and more critical to obtain the desired amount of lace tightness. Other parameters, such as motor current, can be used as secondary measures of lace tightness or continuum position. FIG. 11A includes an illustration of different segment sizes based on position along a tightness continuum.

FIG. 11B illustrates using a tightness continuum position to build a table of motion profiles based on current tightness continuum position and desired end position. The motion profiles can then be translated into specific inputs from user input buttons. The motion profile include parameters of spool motion, such as acceleration (Accel (deg/s/s)), velocity (Vel (deg/s)), deceleration (Dec (deg/s/s)), and angle of movement (Angle (deg)). FIG. 11C depicts an example motion profile plotted on a velocity over time graph.

Figure 11D:
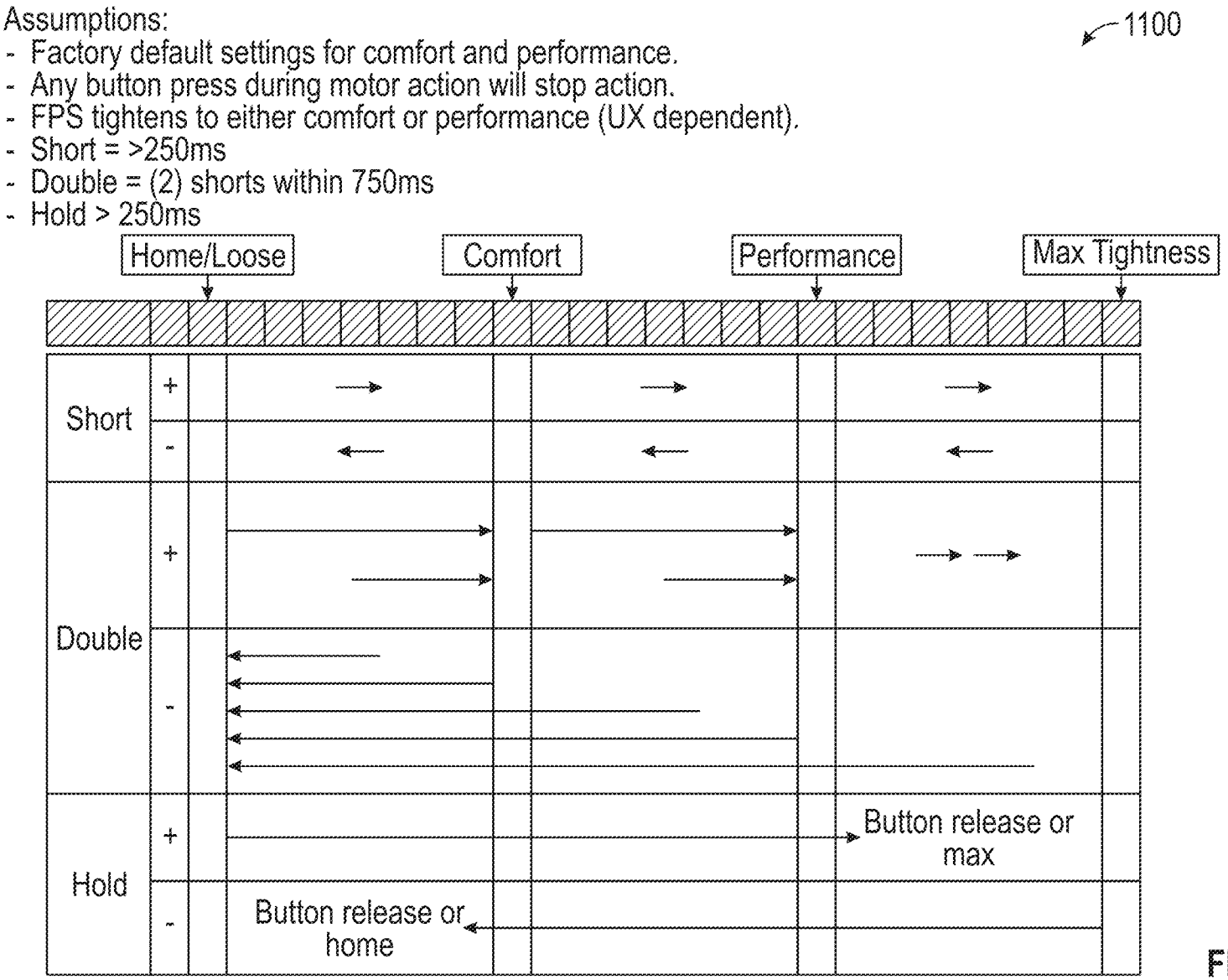

FIG. 11D is a graphic illustrating example user inputs to activate various motion profiles along the tightness continuum.

Additional Notes

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein, such as the motor control examples, can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. for example, the above-described examples (or one or more aspects thereof) may be used in combination with each other. Other embodiments can be used, such as by one of ordinary skill in the art upon reviewing the above description. An Abstract, if provided, is included to comply with United States rule 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A method of operating a lacing engine within a footwear assembly, the method comprising:

receiving, within a lace spool exposed through a superior surface of a housing of the lacing engine, a continuous lace loop of a lace for the footwear assembly; and rotating the lace spool to tighten the lace to secure a foot within the footwear assembly.

2. The method of claim 1, wherein the receiving the continuous lace loop includes receiving a portion of the continuous lace loop within a lace groove running across a diameter of the lace spool.

3. The method of claim 1, wherein the receiving the continuous lace loop includes receiving a section of the lace within a lace channel running in a medial-lateral direction along the superior surface of the housing in alignment with the lace spool.

4. The method of claim 3, wherein the receiving the section of the lace within the lace channel includes receiving a medial portion of the lace on a medial side of the lace spool and a lateral portion of the lace on a lateral side of the lace spool, wherein the lace channel includes a medial section on the medial side of the lace spool and a lateral section on the lateral side of the lace spool.

5. The method of claim 4, wherein the medial section and the lateral section of the lace channel transition into a spool recess; and wherein the receiving the medial portion of the lace on the medial side and the lateral portion of the lace on the lateral side directs the continuous lace loop into the lace spool.

6. The method of claim 1, wherein the rotating the lace spool includes accumulating the lace within a reduced diameter section below a superior surface adapted to accommodate a portion of the lace as the lace is taken up on the lace spool.

7. The method of claim 1, wherein the receiving the continuous lace loop includes receiving a portion of the lace into a lace groove bisecting a superior surface of the lace spool into a reduced diameter spool portion adapted to receive the lace as the lace spool is rotated in a first direction.

8. A method of assembling and operating a footwear assembly with a lacing engine, comprising:

routing a continuous loop of a lace in a medial-lateral direction across a width of a cavity under a footbed of the footwear assembly including the lacing engine that controls an effective length of the lace through engagement with the continuous loop, wherein the cavity is positioned within a longitudinally central portion of the footwear assembly;

receiving the continuous loop of the lace into a mid-section of a lace spool within the lacing engine; and operating the lacing engine to manipulate the effective length of the lace through rotation of the lace spool within the lacing engine.

9. The method of claim 8, wherein the receiving the continuous loop of the lace includes guiding the continuous loop into the lace spool using a lace channel disposed in a top side of a housing of the lacing engine.

10. The method of claim 9, wherein the receiving the continuous loop of the lace includes receiving a medial portion of the lace on a medial side of the lace spool and a lateral portion of the lace on a lateral side of the lace spool, wherein the lace channel includes a medial section on the medial side of the lace spool and a lateral section on the lateral side of the lace spool.

11. The method of claim 10, wherein the medial section and the lateral section of the lace channel transition into a spool recess; and wherein the receiving the medial portion of the lace on the medial side and the lateral portion of the lace on the lateral side directs the continuous lace loop into the lace spool.

12. The method of claim 8, wherein the receiving the continuous loop of the lace includes receiving the continuous loop of lace into a lace groove running across a diameter of the lace spool.

13. The method of claim 12, wherein the lace groove extends inferiorly through the superior surface and into the mid-section of the lace spool.

14. The method of claim 12, wherein the operating the lacing engine includes accumulating the lace within the mid-section of the lace spool upon rotation in a first direction.

15. The method of claim 12, wherein the receiving the continuous loop of the lace includes receiving the lace into a lace groove that bisects a superior surface of the lace spool into two semicircular portions.

16. The method of claim 15, wherein the superior surface of the lace spool is disposed within a circular opening in a top surface of a housing containing the lacing engine.

17. A method of assembling and operating a footwear assembly with a lacing engine, comprising:

inserting the lacing engine into the footwear assembly, the lacing engine including a lace spool exposed through a superior surface of a housing of the lacing engine;

receiving, within the lace spool, a continuous lace loop of a lace for the footwear assembly; and rotating the lace spool to tighten the lace of the footwear assembly.

18. The method of claim 17, wherein the receiving the continuous lace loop includes receiving a portion of the continuous lace loop within a lace groove running across a diameter of the lace spool.

19. The method of claim 17, wherein the rotating the lace spool includes accumulating the lace within a reduced diameter section below a superior surface adapted to accommodate a portion of the lace as the lace is taken up on the lace spool.

20. The method of claim 17, wherein the receiving the continuous lace loop includes receiving a portion of the lace into a lace groove bisecting a superior surface of the lace spool into a reduced diameter spool portion adapted to receive the lace as the lace spool is rotated in a first direction.

* * * * *